US007568240B2

(12) United States Patent
Palay et al.

(10) Patent No.: US 7,568,240 B2
(45) Date of Patent: Aug. 4, 2009

(54) PATIENT TRANSFER SYSTEM

(75) Inventors: Frederic Palay, Summerland Key, FL (US); William E. Burak, Jr., Green Cove Springs, FL (US)

(73) Assignee: Ergo-Asyst Technology LLC, Austin, TX (US)

( * ) Notice: Subject to any disclaimer, the term of this patent is extended or adjusted under 35 U.S.C. 154(b) by 421 days.

(21) Appl. No.: 11/496,961

(22) Filed: Aug. 1, 2006

(65) Prior Publication Data

US 2007/0028381 A1 Feb. 8, 2007

Related U.S. Application Data

(60) Provisional application No. 60/704,398, filed on Aug. 1, 2005.

(51) Int. Cl.
*A61G 7/14* (2006.01)

(52) U.S. Cl. ..... 5/81.1 R; 5/83.1; 5/86.1; 5/612; 5/613

(58) Field of Classification Search ..... 5/81.1 R, 5/81.1 HS, 83.1, 86.1, 87.1, 606, 612, 613, 5/88.1, 89.1, 190, 191
See application file for complete search history.

(56) References Cited

U.S. PATENT DOCUMENTS

| | | | | | |
|---|---|---|---|---|---|
| 1,459,112 | A | * | 6/1923 | Mehl | 5/88.1 |
| 1,857,031 | A | * | 5/1932 | Schaffer | 5/86.1 |
| 2,362,721 | A | | 11/1944 | Reynolds | |
| 2,663,030 | A | * | 12/1953 | Dahlberg | 5/86.1 |
| 2,673,987 | A | * | 4/1954 | Upshaw et al. | 5/86.1 |
| 3,271,796 | A | | 9/1966 | Dillman | |
| 3,811,140 | A | | 5/1974 | Burpo | |
| 3,945,063 | A | * | 3/1976 | Matsuura | 5/611 |
| 4,393,529 | A | | 7/1983 | Britz | |
| 4,579,381 | A | | 4/1986 | Williams | |
| 4,783,862 | A | | 11/1988 | Murphy | |
| 4,970,738 | A | | 11/1990 | Cole | |
| 4,997,200 | A | | 3/1991 | Earls | |
| 5,038,425 | A | | 8/1991 | Merry | |

(Continued)

FOREIGN PATENT DOCUMENTS

| | | |
|---|---|---|
| EP | 1 142 550 | 10/2001 |

(Continued)

*Primary Examiner*—Michael Trettel
(74) *Attorney, Agent, or Firm*—DuBois, Bryant & Campbell, LLP; J. Seth Randle

(57) ABSTRACT

A system for transferring medical patients utilizes the concept of creating a "hollow space" between the patient and the surface on which he or she is supported. A patient support material mounted to a rigid frame positioned about a bed or other hospital furniture can have slots or openings extending laterally inward from at least one side of the patient support material and oriented substantially perpendicular to a line running from the head of the bed to the foot of the bed. The slots allow respective tines of a transport device, or straps from a patient transfer chair or device, to be inserted beneath a patient lying on the patient support material such that the tines or straps (or other elongated patient support/transfer components) can be lifted above through the slots and thus transfer the patient from the patient support material to the tines or straps of the patient transfer/transport device. Associated patient support chairs/devices, lift carts, lifts, carts, and other accessories can be used to lift and transport the patient.

46 Claims, 21 Drawing Sheets

U.S. PATENT DOCUMENTS

| | | | | |
|---|---|---|---|---|
| 5,112,076 | A | 5/1992 | Wilson | |
| 5,263,213 | A | 11/1993 | Robertson et al. | |
| 5,333,887 | A | 8/1994 | Luther | |
| 5,375,277 | A | 12/1994 | Carr et al. | |
| 5,572,756 | A | 11/1996 | Muuranen et al. | |
| 5,704,081 | A | 1/1998 | Bollinger | |
| 5,737,782 | A * | 4/1998 | Matsuura et al. | 5/86.1 |
| 5,839,134 | A | 11/1998 | Matsuura et al. | |
| 5,934,282 | A | 8/1999 | Young, III et al. | |
| 5,966,754 | A | 10/1999 | Schuster | |
| 6,154,899 | A | 12/2000 | Brooke et al. | |
| 6,336,235 | B1 | 1/2002 | Ruehl | |
| 6,381,781 | B1 | 5/2002 | Bourgraf et al. | |
| 6,430,761 | B1 | 8/2002 | Brandorff et al. | |
| 6,477,728 | B1 | 11/2002 | Faz | |
| 6,691,349 | B2 | 2/2004 | Blevins | |
| 6,799,342 | B1 * | 10/2004 | Jarmon | 5/613 |
| 2004/0049855 | A1 | 3/2004 | Leoutsakos | |

FOREIGN PATENT DOCUMENTS

| | | | |
|---|---|---|---|
| EP | 1 300 127 | A2 | 4/2003 |
| FR | 2 678 511 | | 1/1993 |
| GB | 0370607 | | 4/1932 |
| GB | 0882351 | | 11/1961 |
| GB | 1174895 | | 12/1969 |
| GB | 1186697 | | 4/1970 |
| GB | 2 213 735 | | 8/1989 |
| GB | 2 277 020 | | 10/1994 |
| WO | WO 91/12975 | A1 | 9/1991 |
| WO | WO 98/34575 | A2 | 8/1998 |
| WO | WO 2004/039300 | A1 | 5/2004 |
| WO | PCT/US2006//029925 | | 1/2006 |

* cited by examiner

PATIENT TRANSFER SYSTEM

CROSS-REFERENCE TO RELATED APPLICATIONS

This application claims the priority of U.S. Provisional Patent Application Ser. No. 60/704,398, filed Aug. 1, 2005, the entire content of which is incorporated herein by reference.

BACKGROUND OF THE INVENTION

The present invention is directed to a system for transferring patients to and from a bed. Traditionally, this transfer has been a manual task performed by caregivers. Unfortunately, the risk of low back pain and musculoskeletal injury increases with the frequency of patient handling.

Rapid growth in the lift segment is outpacing pure demographics due to the epidemic shortage in the nursing workforce. Occupational Safety and Health Administration (OSHA) regulatory policies, and public concern for quality care in nursing homes and hospitals. Workplace injury as a result of lifting and moving patients is a major problem for the nursing industry, which is already in high demand. In fact, there are "safe-lifting" or "no-lift" policies in effect in nursing homes and hospitals across the country. OSHA has concluded that workers' injuries in nursing homes alone will reach 200,000 incidents, at a cost of almost $1 billion dollars, per year. Most of these injuries are directly related to patient transfers. Injuries to caregivers in the home care setting are estimated to be even higher due to the lack of proper equipment.

Proper use of patient lift products and systems has been shown to dramatically reduce workplace injury. Known products include hoist floor-based lifts and ceiling-based lifts. Floor-based lifts utilize a large "crane-line" lift unit that lifts the patient with a fabric sling. These products are outdated in design, difficult to use, can be unsafe, and do not serve as a solution to mobility (transportation) aid. Furthermore, many known institutional floor-based lifts cannot be stored in the patients' room due to their large size and, instead, are kept in distant locations and shared among all patients on the nursing unit or floor. This practice is not conducive to easy access and leads to underutilization. Ceiling-based lifts, using the same fabric slings, are becoming popular because of these storage issues, but are very expensive and require changes to infrastructure for installation. Other drawbacks include patient anxiety and patient safety issues.

SUMMARY

A system for transferring medical patients utilizes the concept of creating a "hollow space" between the patient and the surface on which he or she is supported. A patient support material mounted to a rigid frame positioned about a bed or other hospital furniture can have openings extending laterally inward from at least one side of the patient support material and oriented substantially perpendicular to a line running from the head of the bed to the foot of the bed. The openings allow respective tines of a transport device, or straps from a patient transfer chair or device, to be inserted beneath a patient lying on the patient support material such that the tines or straps (or other elongated patient support/transfer components) can be lifted above through the openings and thus transfer the patient from the patient support material to the tines or straps of the patient transfer/transport device. Associated patient support chairs/devices, lift carts, lifts, carts, and other accessories can be used to lift and transport the patient.

Accordingly, it is a first aspect of the present invention to provide a device to assist in patient care including: a substantially rigid frame defining a patient-support area within an area bounded by the frame, the frame being adapted to be positioned with respect to a patient bed such that the patient support area substantially lies on a plane substantially parallel to a plane of an upper patient receiving surface of the bed; and a patient support material mounted to the frame so as to extend within the patient support area of the frame, the patient support material having at least two openings extending laterally inward from at least one side of the patient support material and oriented substantially perpendicular to a line running from the head of the bed to the foot of the bed; where the openings allow at least two respective elongated patient support/transfer components (such as, for example, tines of a lift cart or straps of a transfer chair/frame) of a transport device to be inserted beneath a patient lying on the patient support material such that the tines can be lifted above through the openings and thus transfer the patient from the patient support material to the elongated components.

In the first aspect, the frame can include two or more sections pivotally joined together along a hinged lateral axis. The patient support material can include two or more sections, each of which is mounted to one of the sections of the frame, and each section of the patient support material having at least one opening to allow a tine of the transport device to be inserted beneath the patient lying on the patient support material. In another detailed embodiment, the device further includes a lift device associated with the frame, the life device including an actuator that, upon actuation of the actuator, vertically lifts the frame such that the patient support material is elevated above the bed. The lift device can utilize at least one of manual, electric, hydraulic, and pneumatic application of force. In another detailed embodiment, the frame is elevated from the floor upon a wheeled base. The frame can include a downwardly facing gap that extends laterally across the bed, such that the frame can be translationally moved relative to the bed, at least a portion of the bed being cleared by the gap. In another detailed embodiment, the patient support material includes a plurality of straps extending laterally inward from at least one side of the sheet and oriented perpendicular to a line running from the head of the bed to the foot of the bed, the straps defining openings (slots in the exemplary embodiments) between adjacent straps. The openings can include a resilient material extending therein, the resilient material being joined to a relatively less resilient material forming the patient support material areas bounding adjacent openings. The resilient material can stretch downwardly to allow tines of the transport device to slide under the patient.

It is a second aspect of the present invention to provide a transport system to assist in patient care that includes: a patient support assembly including a patient support surface, where the patient support assembly includes at least two openings extending laterally inward from a side of the patient support surface; and a transport device. The transport device includes: (a) a base unit; (b) an extraction-frame unit joined to the base unit by a lifting mechanism adapted to move the extraction-frame unit translationally at least in a substantially vertical direction with respect to the base unit; and (c) at least two tines extending substantially horizontally from the extraction frame unit; where the tines can respectively fit into the at least two openings of the patient support assembly, thus allowing the tines to be inserted beneath a patient lying on the patient support surface such that the tines can be lifted above through the openings and thus transfer the patient from the patient support surface to the tines. In a more detailed embodiment, the base unit includes a plurality of wheels such that the base unit can be moved by rolling.

In an alternate detailed embodiment of the second aspect of the present invention, the extraction-frame unit includes a first torso-support frame portion and a second thigh-support frame portion, where the first and second frame portions are pivotally joined together along a hinged axis. In a further detailed embodiment, the second thigh-support frame portion includes at least two tines extending substantially horizontally from the second thigh-support frame portion, and the first torso-support frame portion includes one or more tines extending substantially horizontally from the first torso-support frame portion. Alternatively or in addition, the first torso-support frame portion can be pivoted between at least a partially vertical position such that the transport device can support the patient in a sitting position and an approximately horizontal position such the transport device can support the patient in a supine position. Alternatively or in addition, the transport system may include removable cushions that can be fitted to the first and second frame portions. Alternatively or in addition, the extraction-frame unit may include a third below-knee support frame portion pivotally joined to the second thigh-support frame portion along a hinged axis. This third below-knee support frame portion may include one or more substantially parallel tines extending substantially horizontally from the third below-knee support frame portion. Further, the third frame portion can be pivoted between at least a partially downward vertical position such that the transport device can support the patient in a sitting position and an approximately horizontal position such that the transport device can support the patient in a supine position.

In another alternate detailed embodiment of the second aspect of the present invention, the base unit includes at least one motor driven wheel, providing motorized movement of the base unit. In a further detailed embodiment, the transport device further includes user controls for controlling the motorized movement of the base unit. In yet a further detailed embodiment, the user controls are capable of being reoriented between a patient-control orientation and an assistant-control orientation.

In other detailed embodiments of the second aspect of the present invention, the transport device may include a weight detector that is adapted to measure the patient's weight; and/or the lifting mechanism of the transport device operates using at least one of manual, electric, hydraulic, and pneumatic application of force; and/or the transport system further includes at least one folding tine joined to the extraction-frame unit, selectively foldable into and out of a substantially horizontal patient support orientation; and/or at least one tine is selectively removable from the extraction-frame unit.

It is a third aspect of the present invention to provide a patient transfer system to assist in patient care that includes: a patient support assembly including a patient support surface, the patient support assembly including at least one laterally extending opening extending into the patient support surface; and a patient transfer device including a patient transfer frame, where the patient transfer frame includes an elongated transfer component (such as a support arm or strap) adapted to be inserted laterally into the opening beneath the patient. In a more detailed embodiment, the patient transfer frame includes: at least two side bars; at least one rigid cross bar joined to the side bars; at least one patient support strap adapted to be fastened to and extend between the side bars (the at least one strap providing the elongated transfer component); and at least one first coupling component provided on the patient transfer frame and adapted to be coupled to a first complementary coupling component of a first patient lift device. In yet a further detailed embodiment, the patient transfer system further includes a first patient lift device having: a base assembly, a beam joined to the base assembly and adapted to extend over a patient bed, the first complementary coupling component (adapted to be coupled to the first coupling component of the patient transfer frame) provided on the beam, and a lift mechanism implemented in the base unit for raising the beam; where the first patient lift device can be coupled to the patient transfer frame and used to lift the patient from the bed. In yet a further detailed embodiment, the first complementary coupling component is provided on a carriage riding on the beam. In yet a further detailed embodiment, the carriage is selectively translatable along the beam.

It is also within the scope of the third aspect of the present invention that the patient transfer frame includes a second coupling component adapted to be coupled to a second complimentary coupling component of a patient mobility device. With this, the patient transfer system may further include: a patient mobility device having a wheeled base unit and the second complimentary coupling component (adapted to be coupled to the second coupling component of the patient transfer frame), where the patient transfer frame rides on the wheeled base unit when coupled.

It is also within the scope of the third aspect of the present invention that the patient transfer frame includes at least two side bars; at least one rigid cross bar joined to the side bars; the elongated transfer component; and at least one first coupling component provided on the patient transfer frame and adapted to be coupled to a first complementary coupling component of a first patient lift device.

It is a fourth aspect of the present invention to provide a method of transporting a patient, comprising the steps of: (a) providing a substantially rigid frame defining a patient-support area within an area bounded by the frame, where the frame is adapted to be positioned with respect to a patient bed such that the patient support area substantially lies on a plane substantially parallel to a plane of an upper patient receiving surface of the bed; (b) providing a patient support material mounted to the frame so as to extend within the patient support area of the frame, where the patient support material has at least two openings extending laterally inward from at least one side of the patient support material and oriented substantially perpendicular to a line running from the head of the bed to the foot of the bed; (c) inserting at least two tines of the transport device into the openings in the patient support material beneath the patient lying on the patient support material; and (d) lifting the tines of the transport device through the openings such that the patient is supported by the tines and not by the patient support material. In a further detailed embodiment, the method further includes the steps of: (e) moving the transport device away from the bed such that the tines of the transport device are no longer positioned over the bed and the patient support material; and (f) moving the transport device to a desired location.

In an alternate detailed embodiment of the fourth aspect of the present invention, the method further includes the step, prior to the inserting step (c), of increasing the vertical distance between the patient support material and the bed such that the patient is supported by the patient support material and not by the bed. In another alternate detailed embodiment, the method further includes the step, prior to the inserting step (c), of moving the frame defining a patient-support area away from the bed such that the patient is supported by the patient support material and not by the bed.

It is a fifth aspect of the present invention to provide a method that includes the steps of: (a) providing a substantially rigid frame defining a patient-support area within an area bounded by the frame, where the frame is adapted to be positioned with respect to a patient bed such that the patient support area substantially lies on a plane substantially parallel to a plane of an upper patient receiving surface of the bed; (b) providing a patient support material mounted to the frame so as to extend within the patient support area of the frame, where the patient support material has at least one opening extending laterally inward from at least one side of the patient support material and oriented substantially perpendicular to a line running from the head of the bed to the foot of the bed; (c) placing a patient transfer frame about the patient's body, the patient transfer frame having at least two side bars, a rigid cross bar joined to the side bars, at least one strap adapted to extend laterally between and be fastened to the side bars, and at least one coupling component provided on the patient transfer frame and adapted to be coupled to a complementary coupling component of a patient transfer device; (d) routing the at least one strap through the at least one opening in the patient support material under the patient and fastening the strap laterally between the side bars of the patient transfer frame; (e) coupling the complementary coupling component of the first patient transfer device to the coupling component provide on the patient transfer frame; and (f) moving the patient and the patient transfer frame away from the bed using the first patient transfer device. In a more detailed embodiment, the method further includes the step, prior to the routing step (d), of increasing the vertical distance between the patient support material and the bed such that the patient is supported by the patient support material and not by the bed. Alternatively, the method further includes the step, prior to step (d), of moving the frame defining a patient-support area away from the bed such that the patient is supported by the patient support material and not by the bed.

These and other aspects and embodiments will be apparent from the following description, the accompanying drawings, and the appended claims.

DETAILED DESCRIPTION

The present invention is directed to a patient transfer system utilizing the concept of creating a "hollow space" between the patient and the surface on which he or she is supported and then extracting the patient using the hollow space to insert elongated patient support/transfer components such as tines of a lift cart, straps of an extraction device, etc. The patient support assembly of the present invention as depicted in the following exemplary embodiments is designed to: (a) enable the safe raising and lowering of a patient above his or her bed; (b) allow for insertion and removal of a mobile supporting expedient under the patient; and (c) when in the lowered position, provide a comfortable surface for the patient.

The patient transfer device of the present invention as depicted in the following exemplary embodiments is designed to: (a) enable the safe movement of patients requiring substantial assistance into and out of a bed and (b) provide a mobile, multi-position stretcher/chair on which patients can be transported.

FIGS. 1-4 illustrate two exemplary embodiments of a patient support assembly 103, 103' designed to raise and lower a patient above his or her bed 105. The patient support assemblies 103, 103' include a base frame 100 sized to fit over or about a standard hospital-type bed or normal bed, allowing it to be used in both health care settings and in homes.

Figure 1:
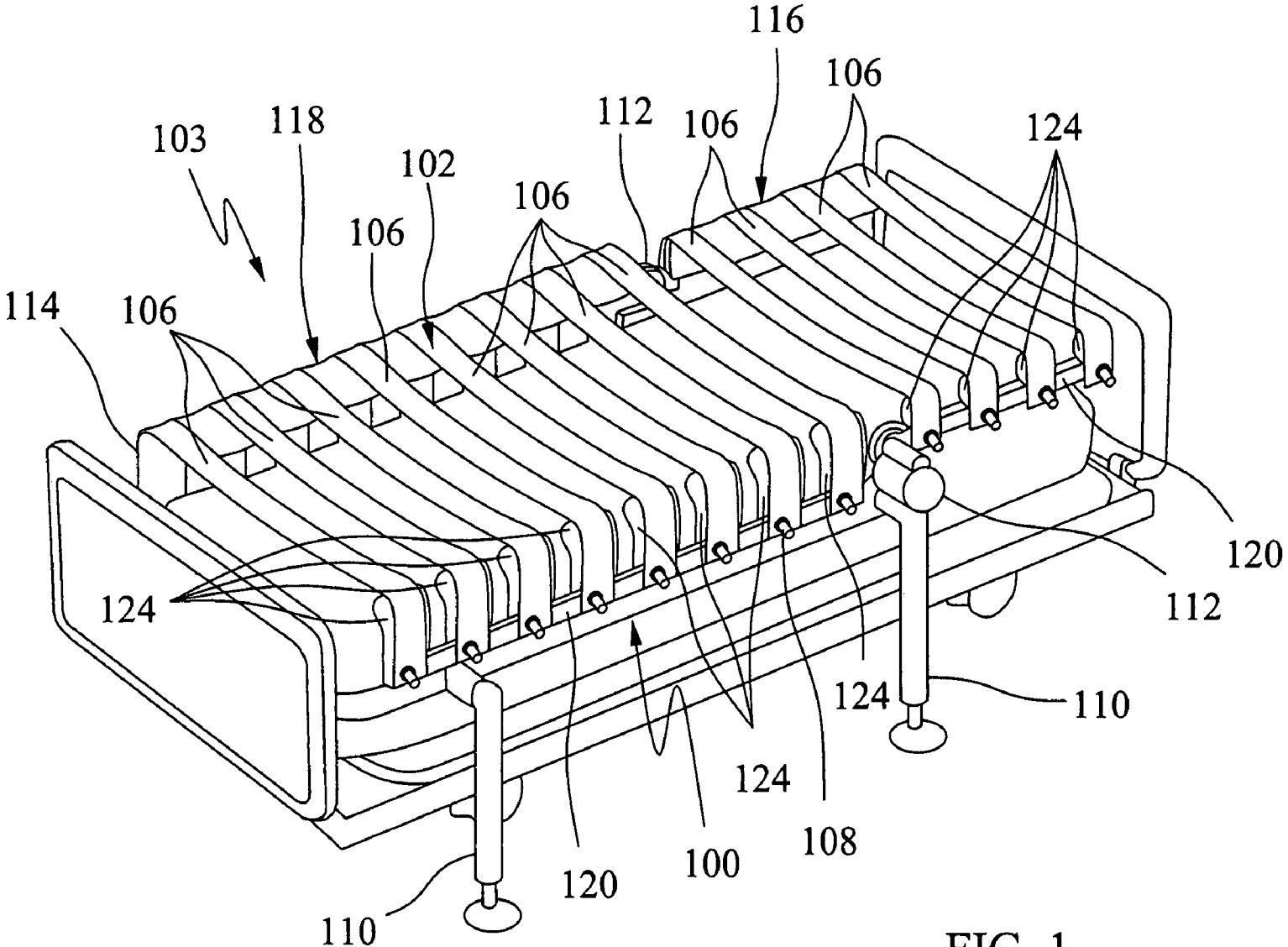
FIGS. 1 and 2 show a patient support and transfer assembly, according to one exemplary embodiment of the present invention as installed about a patient's bed.

FIG. 1 shows a base frame 100 including a patient support material 102, elevator mechanisms 110, upper frame 114, and hinges 112. The upper frame 114 generally defines a patient support area that lies on a plane substantially parallel to the plane of the bed mattress. In this embodiment, the upper frame 114 includes an upper head/chest segment 116 pivotally coupled to a lower hip/leg segment 118. The hinges 112 allow the head/chest segment 116 of the upper frame 114 to be raised, thus allowing a normal bed to have an inclined head/chest area like a hospital bed.

Each segment 116, 118 of the upper frame 114 in this embodiment includes a pair of longitudinal bars 120 and at least one lateral cross bar 122 extending between the longitudinal bars 120 such that the longitudinal bars and cross bar provides substantially rigid structural support for the frame segment. Each segment 116, 118 in this embodiment also includes a plurality of lateral straps 106 (providing the patient support material 102) extending laterally between the longitudinal bars 120. The lateral straps 106 are releasably coupled in this embodiment to the longitudinal bars 120 at coupling points 108. A pair of risers 124 are provided for each strap 106 and are mounted to the longitudinal bars 120 approximate to the coupling points 108 so that the straps 106 extend up form the bars 120 over the first of the pair of risers 124 and across to the next of the pair of risers 124. The risers 124 thus extend the patient support material 102 above the longitudinal bars 120 of the upper frame 114.

The base frame 100 is positioned about a bed 105 and the patient support material 102 is attached using coupling points 108 before the patient is placed in the bed. When it becomes necessary to remove the patient from the bed, the elevator mechanisms 110 are used to raise the upper frame 114 and the attached patient support material 102 above the mattress creating a "hollow space" between the patient support material 102 and the bed 105. Alternatively, when the assembly 103 is used with a bed that can be raised and lowered, the upper frame 114 and patient support material 102 can remain stationary and the bed can be lowered to create the "hollow space" beneath the patient between the patient support material 102 and the bed 105.

The elevator mechanisms 110 can be operated hydraulically, pneumatically, by a motorized mechanism, manually, or by any other conventional mechanisms capable of raising and at least the lowering upper frame 114 as commonly known to those of ordinary skill in the art. In an alternative embodiment (not shown), the upper frame 114 is lifted above the bed by supplying compressed air to inflatable bladders positioned between the upper frame 114 and the mattress or between the existing bed and the upper frame 114. As the bladders inflate, they lift the upper frame 114 away from the mattress, thus creating the "hollow space" necessary for the tines of an extractor 200 as will be described below.

Figure 2:
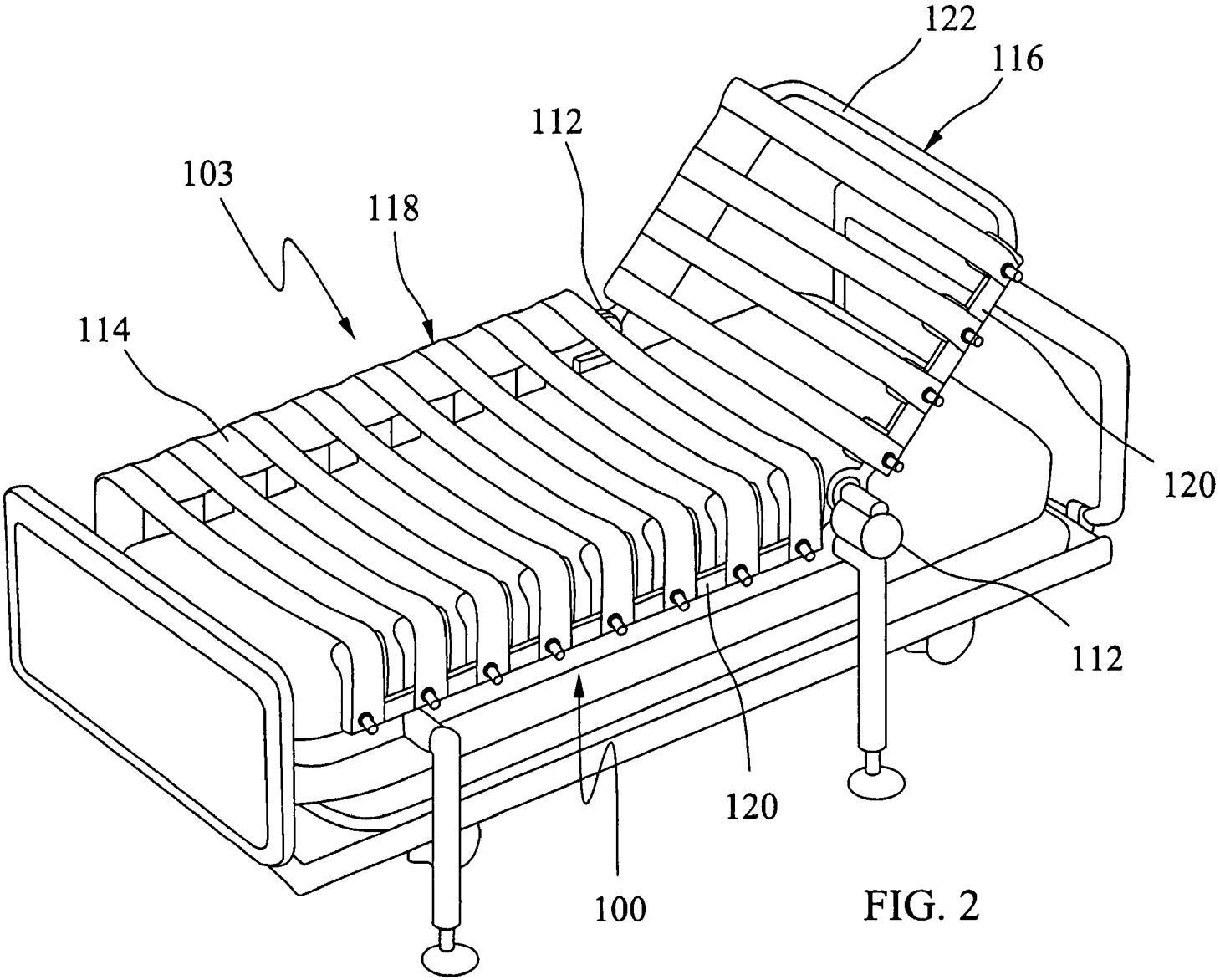

FIG. 2 shows the assembly 103 with the head/chest segment 116 of the upper frame 114 in a raised position. Hinges 112 allow this motion. In a further embodiment of the invention, additional hinges are provided to allow the foot portion of the upper frame 114 to be elevated or lowered. The articulated portion of the upper frame 114 can be placed in different positions, which can prevent a patient from sliding down the bed, and can also prevent pressure points related to prolonged bed rest and poor positioning on the bed.

Figure 3:
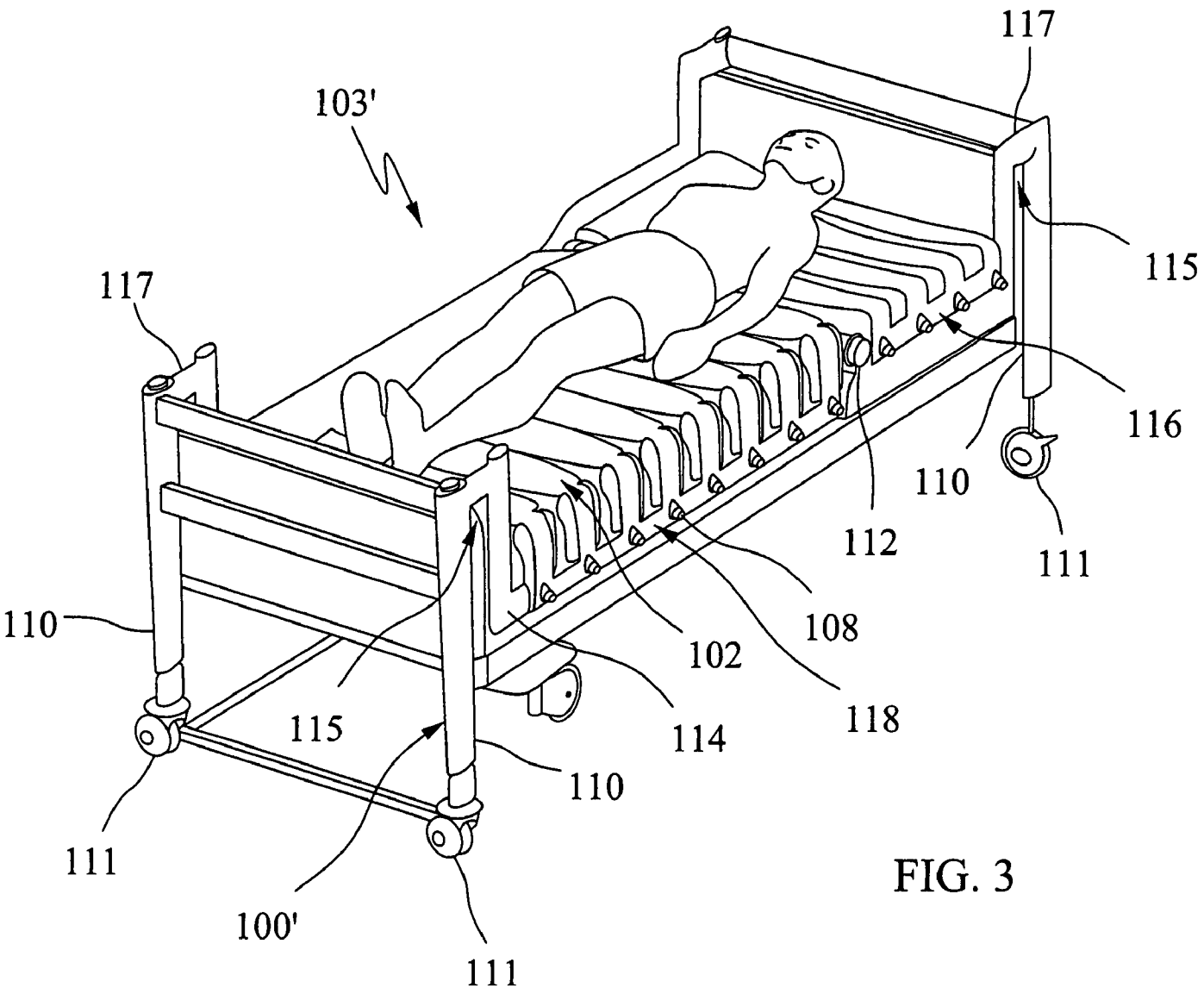
FIGS. 3 and 4 show a patient support and transfer assembly, according to another exemplary embodiment of the present invention as installed about a patient's bed.
Figure 4:
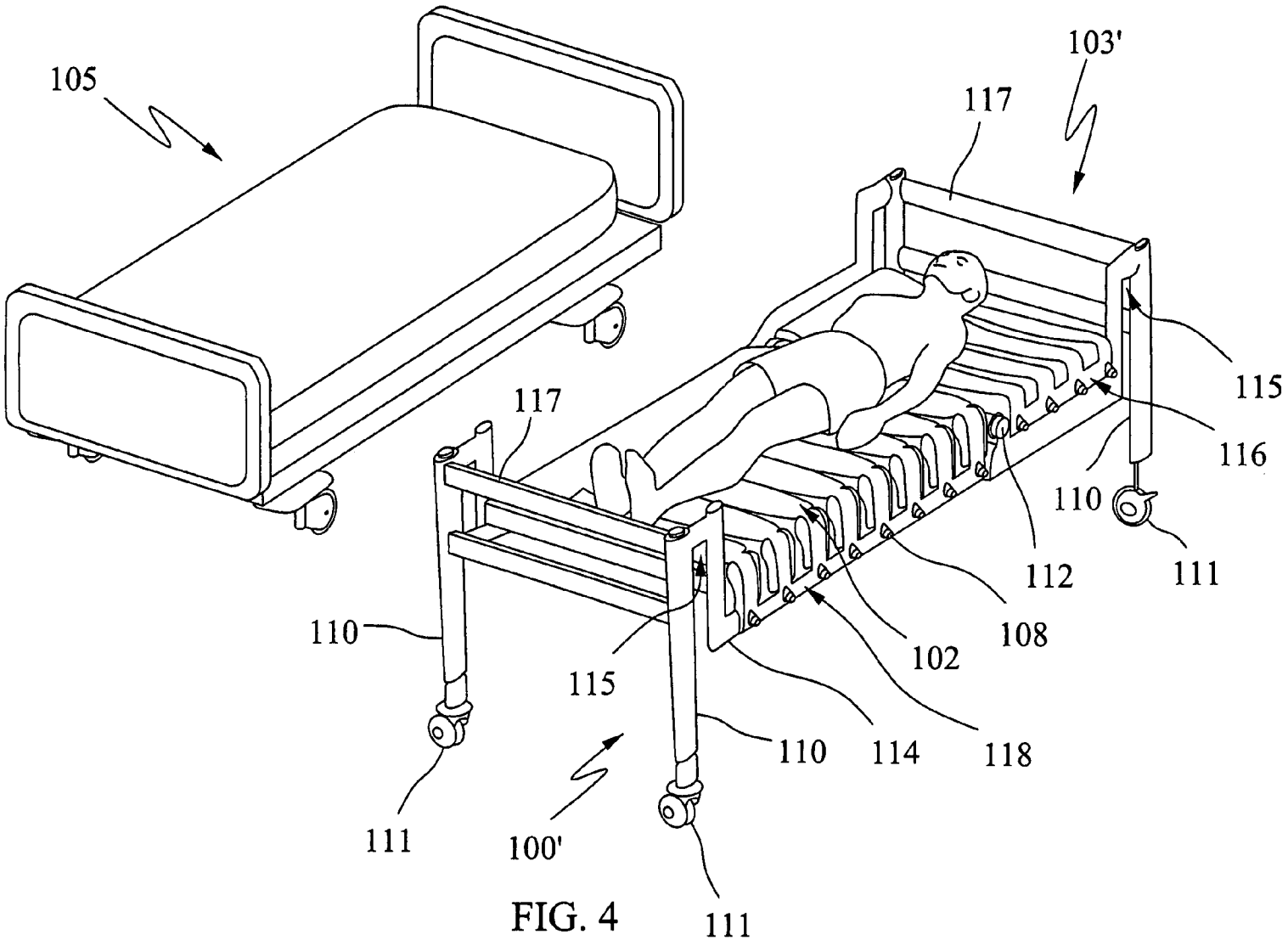

FIGS. 3 and 4 illustrate an alternative exemplary embodiment of the patient support assembly frame 103'. In this embodiment, the base frame 100' is constructed with downward facing gaps 115, which allow the end portions 117 of the frame 100' to fit over the headboard and footboard of the patient's bed 105 such that the entire frame 100' can be easily rolled over the bed 105 as shown in FIG. 3 and easily rolled away from the bed 105 as shown in FIG. 4. Similar to the embodiment shown in FIGS. 1 and 2, this embodiment 103' includes a base frame 100', a patient support material 102, optional elevator mechanisms 110, upper frame 114, and hinges 112. The hinges 112 allow the head/chest segment 116 of the frame to be raised, thus allowing a normal bed to have an inclined head/chest area like a hospital bed. As in the first exemplary embodiment, a further embodiment may include additional hinges that allow the foot portion of the upper frame 114 to be articulated. Additionally, wheels 111 are provided to permit easy movement of the base frame 100'. Although they are not shown in FIGS. 1 and 2, wheels 111 can optionally be used on either exemplary embodiment of the present invention.

This embodiment of the assembly 103' has the additional advantage that it can be rolled away from the patient's bed while the patient is supported by the upper frame 114, as shown in FIG. 4. This greatly increases the flexibility available for personnel caring for the patient. For example, this capability allows easier transportation and bathing of patients as well as easier linen changes on the patient's bed.

Figure 5:
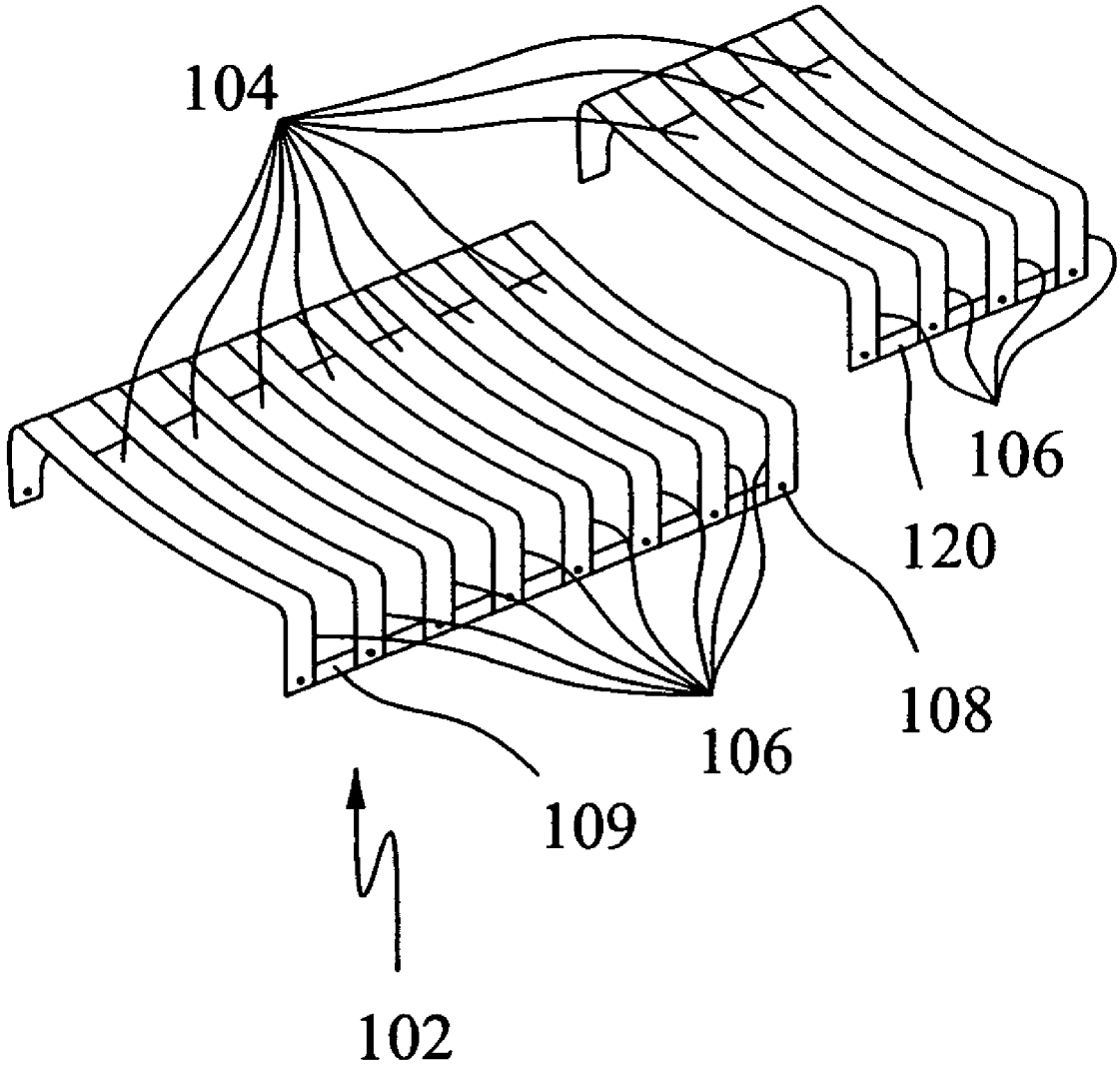
FIG. 5 shows the patient support material webbing, according to an exemplary embodiment of the present invention.

The patient support material 102 shown in FIGS. 1-5 include a webbing of a plurality of lateral straps 106 extending across a patient support area defined by the upper frame 114. FIG. 5 shows a patient support material 102 including coupling points 108 extending along longitudinal side panels 109 of the patient support material, openings in the form of slots 104, and straps 106. The coupling points 108 are designed to couple with corresponding coupling points on the upper frame 114. Between the straps 106 are openings in the form of slots 104 to allow the tines 208 on an extractor 200 to pass through as will be described below. It will be appreciated that the slots 104 also allow for other forms of elongated patient support/transfer components to pass therein, such as straps, arms or other components. It will also be appreciated that other types of openings adapted to extend laterally across a portion of the patient lying on the patient support material my be utilized instead of, or in addition to the slots.

Figures 6A, 6B, 6C, 6D:
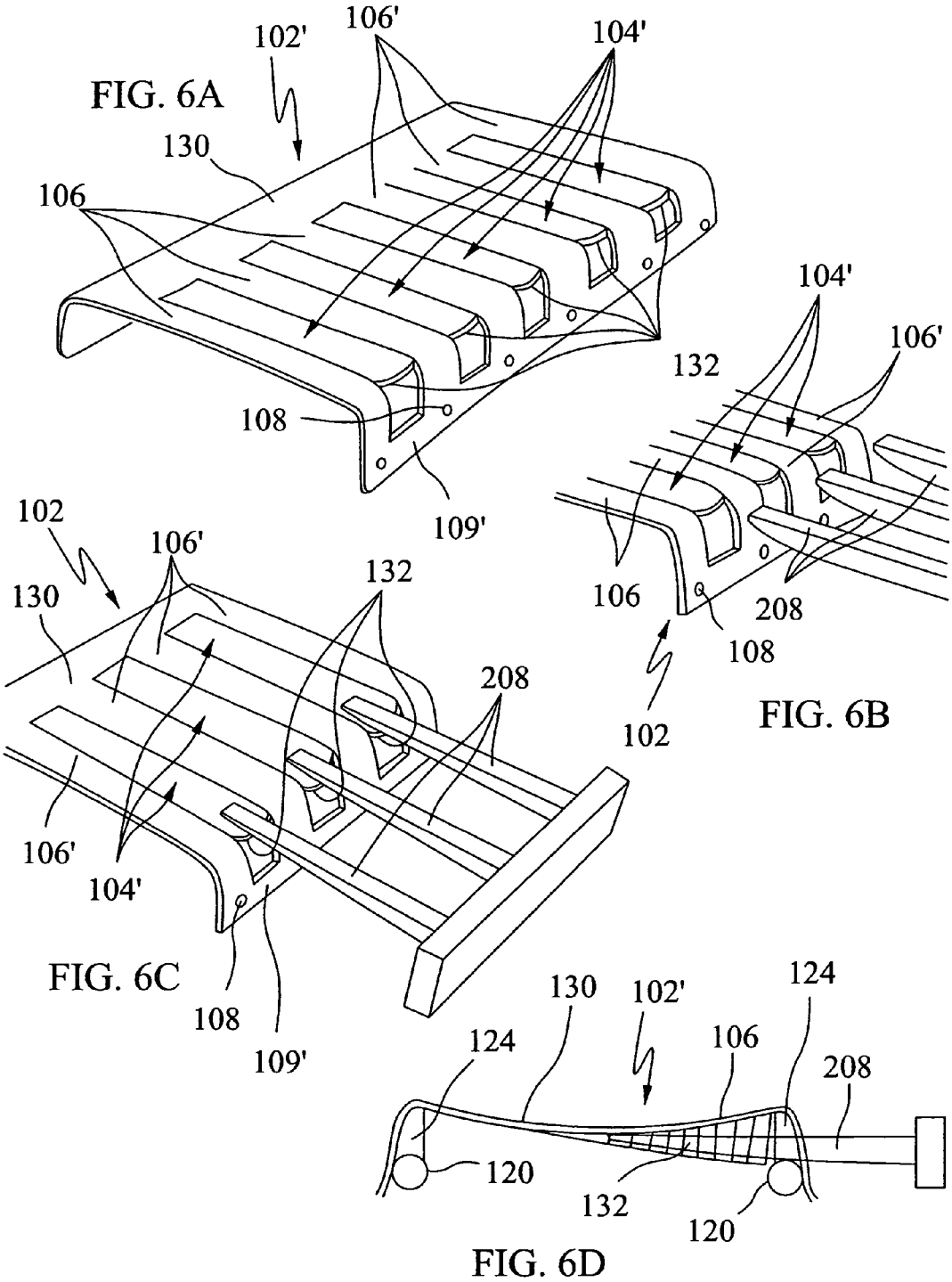
FIGS. 6 and 7 show another embodiment of the patient support material webbing/sheet, according to an exemplary embodiment of the present invention.
Figure 7A:
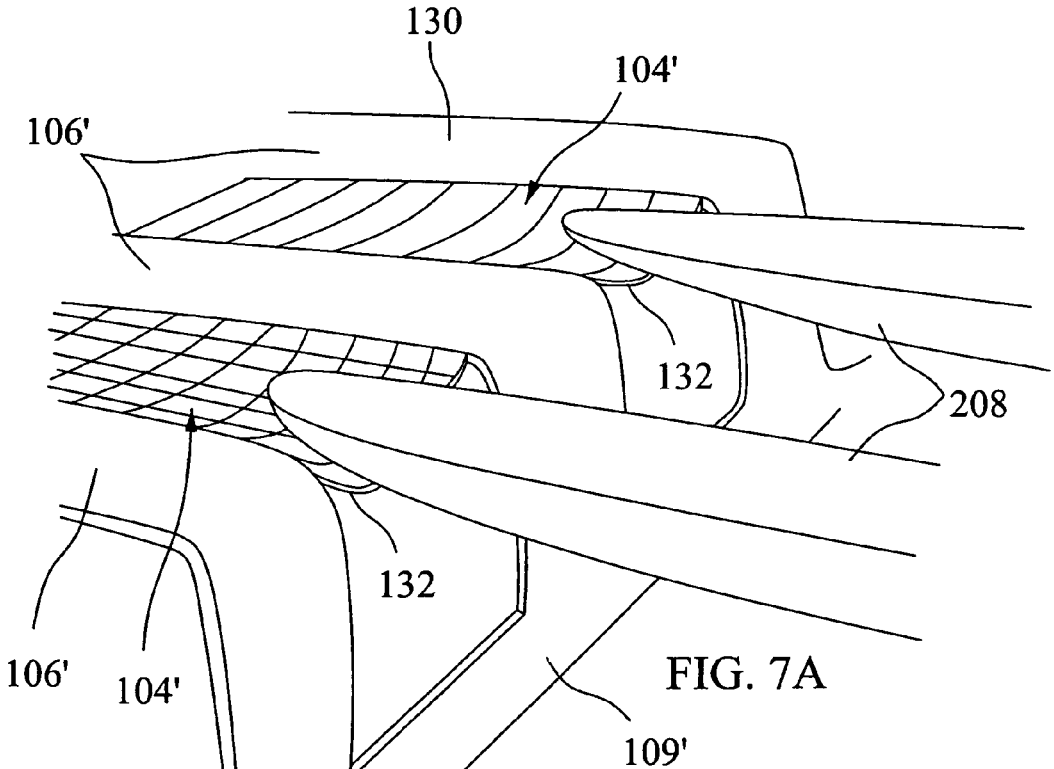
Figure 7B:
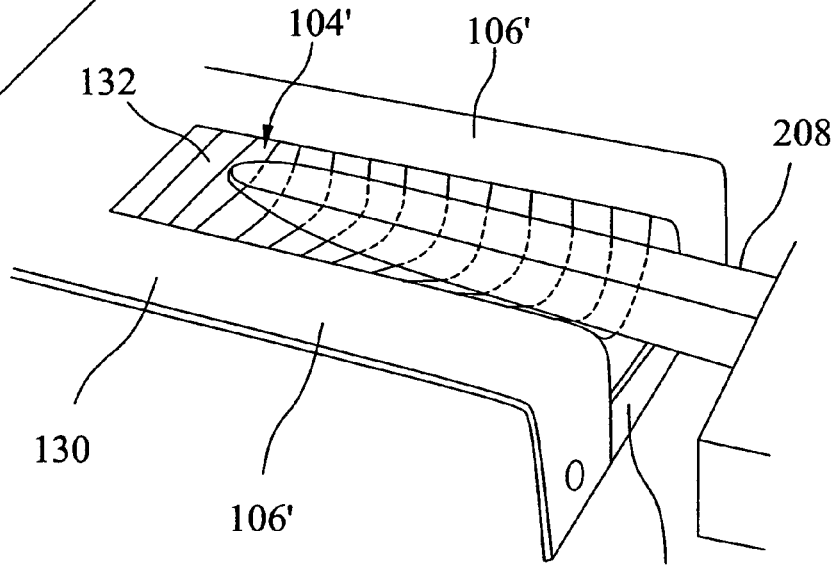

FIGS. 6 and 7 show a further embodiment of a patient support material 102 in the form of a sheet 130. The sheet 130 in this embodiment is constructed similarly to the webbing of FIGS. 1-5, as comprising a plurality of lateral straps 106' of material and a plurality of slots 104' extending therebetween. In this embodiment, the slots 104' between the straps 106' have a stretchable, elastic fabric 132 provided therein. The fabric 132 in the slots 104' provides a continuous and nearly flat surface when the upper frame 114 is lowered and the patient is supported by his or her mattress. When a patient is being loaded onto tines 208 of an extractor 200, the fabric 132 in the slots 104' stretch downward to allow the tines 208 to slide under the patient as shown in FIGS. 6B, 6D, 7A and 7B.

FIGS. 8-13 illustrate three exemplary embodiments of a patient transfer device or extractor 200, 200', 200", which can be used in conjunction with the patient support assemblies described above.

Figure 8:
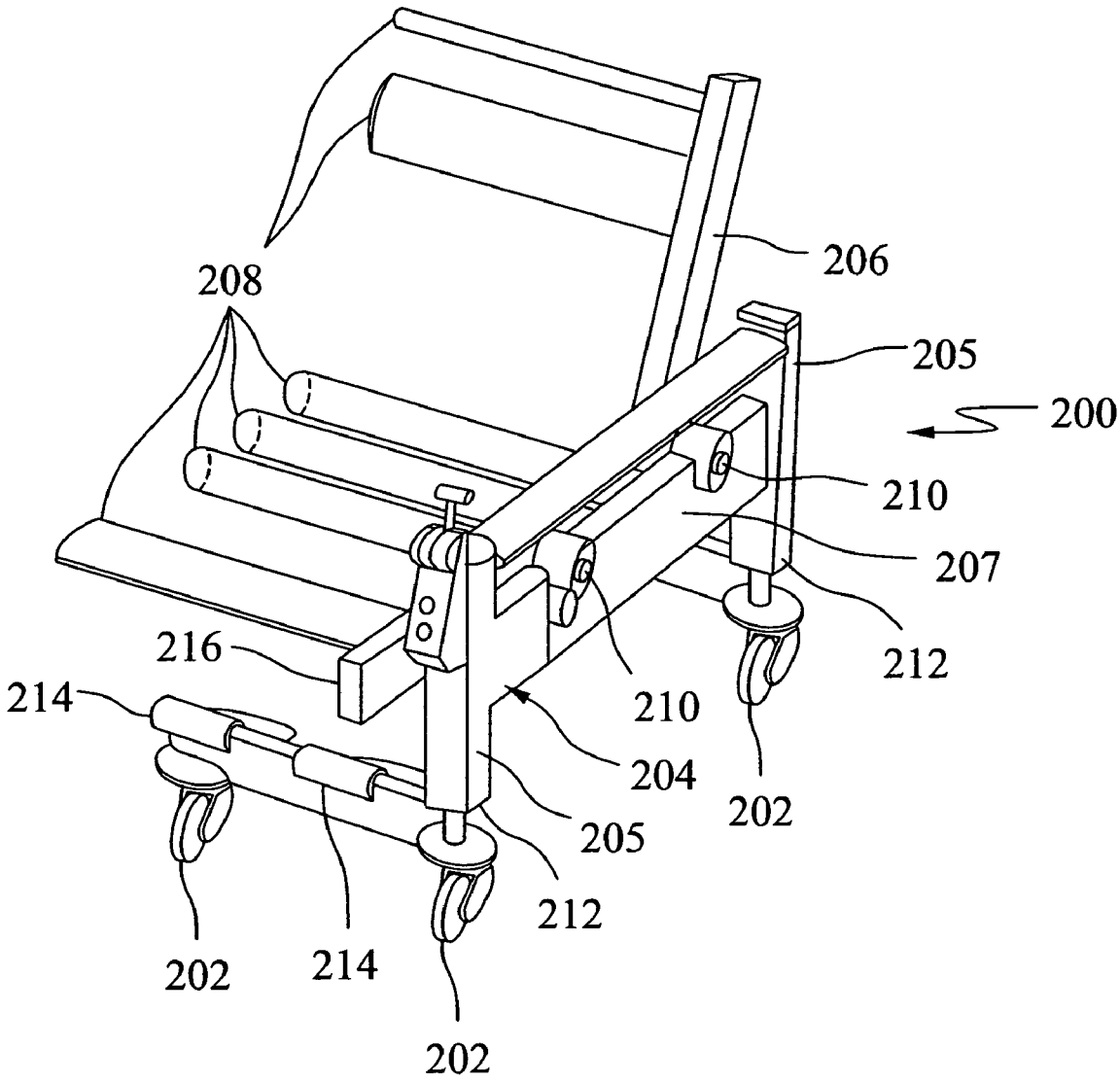
FIGS. 8 through 10 illustrate an embodiment of a transport device used to extract a patient from the patient support material, according to an exemplary embodiment of the present invention.

FIG. 8 shows a first embodiment of an extractor 200 including a base frame 204 including a pair of legs 205 and a longitudinal beam 207 extending thereacross, lift mechanisms 212 associated with the legs 205, a torso-support frame 206 pivotally coupled to the beam 207 (the beam 207 providing a thigh-support frame), calf-support frame 216 coupled to the beam, tines 208 extending laterally from the frames 206, 216, the beam 207, and foot rests 214. The base frame 204 is supported from the floor on four wheels 202 (three are shown). The torso-support frame 206 and the calf-support frame 216 are each coupled to the base frame 204, and each includes a plurality of tines 208 extending laterally therefrom. The beam 207 also includes a plurality of tines 208 extending laterally therefrom. The tines of the torso-support frame 206 are aligned in parallel with each other (if there are more than one) to support the upper torso of the patient and the tines of the beam 207 are aligned in parallel with each other (if there are more than one) to support the thighs of the patient, and the tines of the calf-support frame 216 are aligned in parallel with each other (if there are more than one) to support the calves of the patient. The torso-support and calf-support frames 206, 216 can each be pivoted respectively about joints 210 to allow the patient to be repositioned from a supine position to a sitting position. The tines 208 are spaced to correspond with slots 104, 104' in a patient support material 102. The foot rests 214 are capable of being folded or collapsed. In a further embodiment of the invention, the extractor 200 includes an apparatus for measuring the patient's weight.

The lift mechanisms 212 can be operated hydraulically, pneumatically, by a motorized mechanism, manually, or by any other means capable of raising and lowering frame 204 as will be well known and available to those of ordinary skill in the art.

Figure 9:
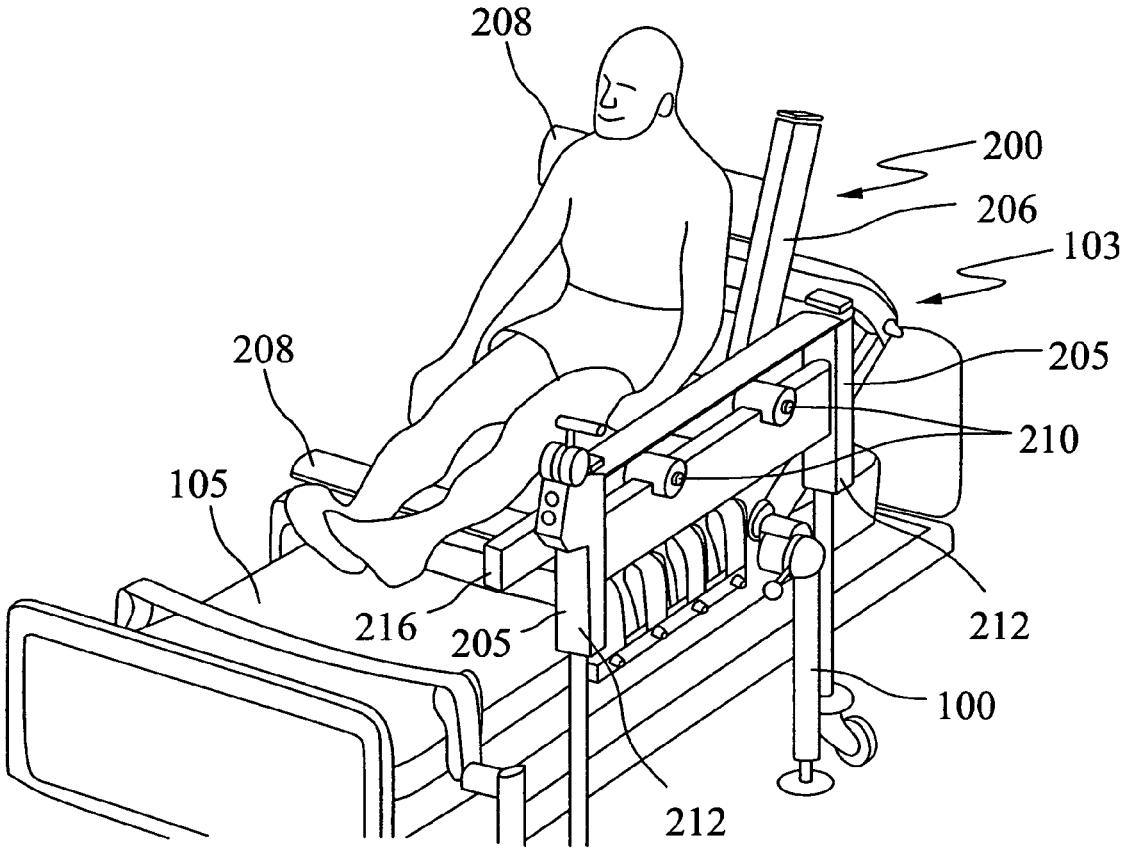

FIG. 9 shows the extractor 200 lifting a patient off of a patient support assembly 103. To remove a patient from a bed, the patient is first raised above the bed using the upper frame 114 as described above (or the bed is lowered). The extractor 200 is maneuvered into position such that the tines 208 are inserted into the slots 104, 104' between the straps 106, 106' of the patient support material 102 as shown in FIGS. 6B, 6C, 6D, 7A and 7B. The tines 208 are then raised using the lift mechanisms 212 until the patient is supported solely by the tines (alternatively the upper frame 114 may be lowered again until the patient is supported solely by the tines). The extractor 200 is pulled away from the bed and the lift mechanisms 212 are adjusted to the desired height. If desired, the torso-support frame 206 and the calf-support frame 216 can be pivoted at joints 210 to change the position of the patient.

Figure 10:
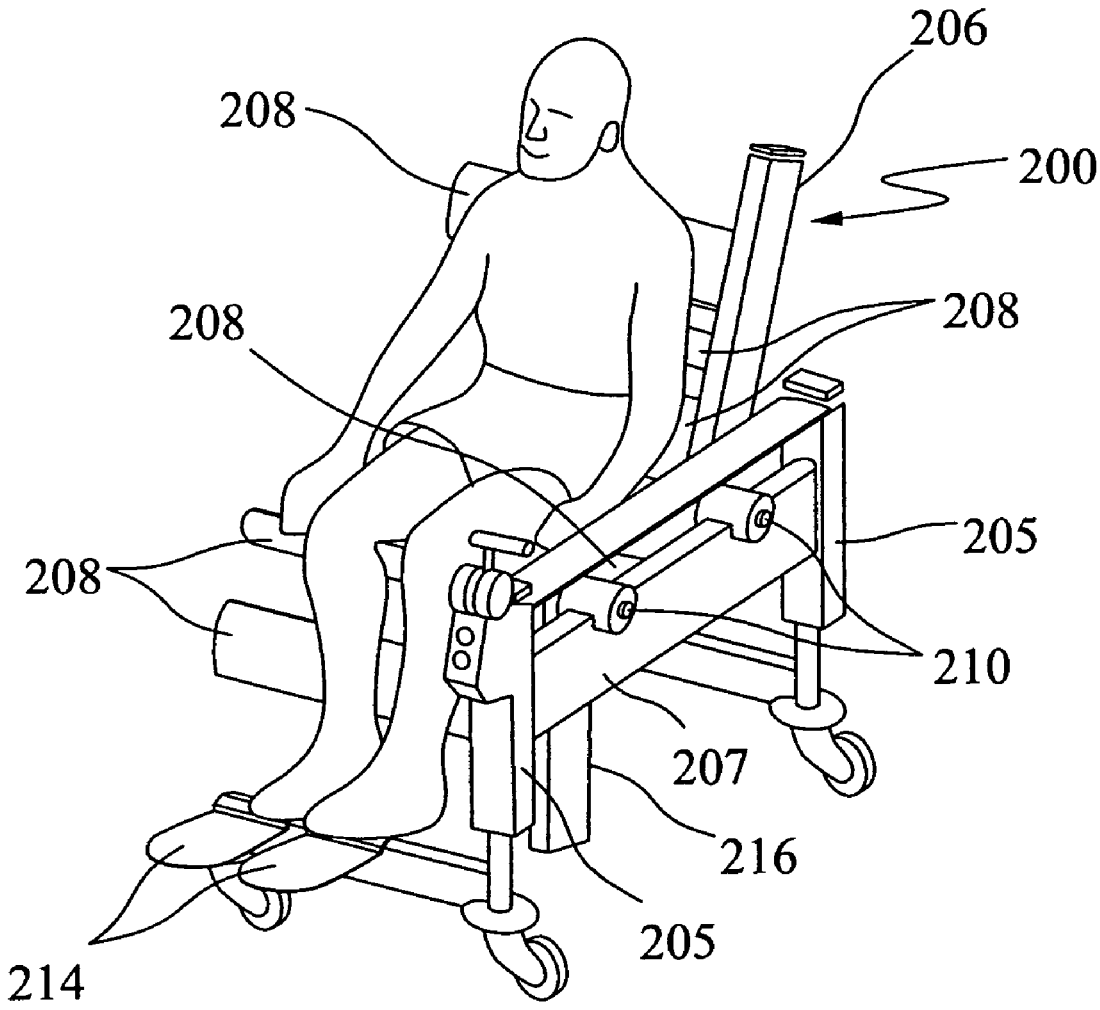

FIG. 10 shows the extractor 200 with a patient in a sitting position. The calf-support frame 216 is in its vertically downward position and the torso-support frame 206 is in its vertically raised position. Also, in this FIG. 10, the foot rests 214 are flipped out to allow the patient to rest his feet thereon.

Although the above-described figures show a patient being moved in a sitting position, the concept is equally applicable to moving patients who are lying flat. Such an application is useful in settings such as an intensive care unit or operating room where a patient is unable to assist with his or her own mobility and it may be desired to allow the patient to remain in a supine position.

Figure 11:
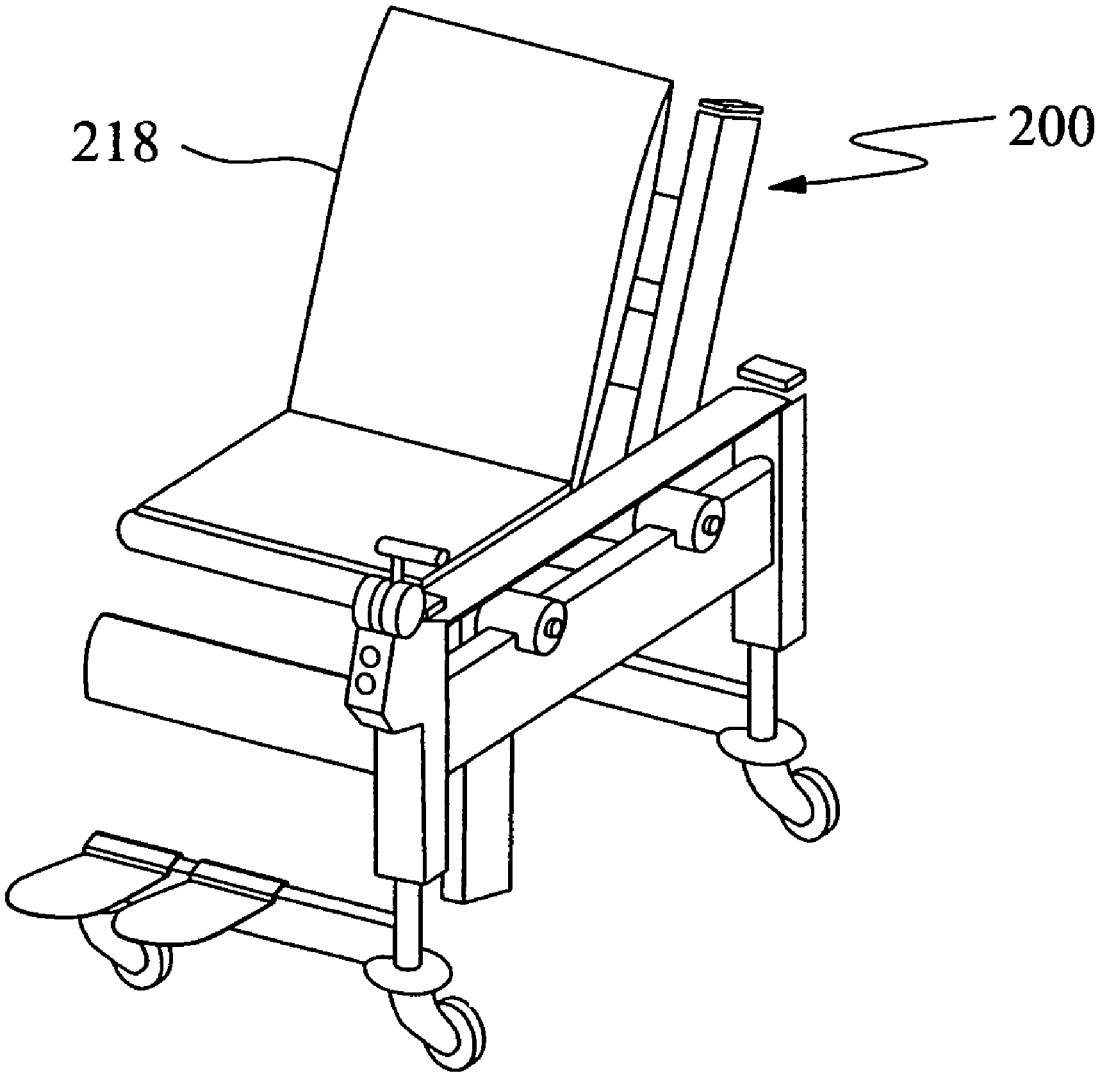
FIG. 11 illustrates the transport device of FIGS. 8-10 fitted with cushions to enable it to be used as a piece of room furniture, according to an exemplary embodiment of the present invention.

FIG. 11 illustrates a further embodiment of the extractor 200. Removable cushions 218 are provided with the extractor 200 so that it can be used as room furniture when it is not needed for moving patients.

Figure 12A:
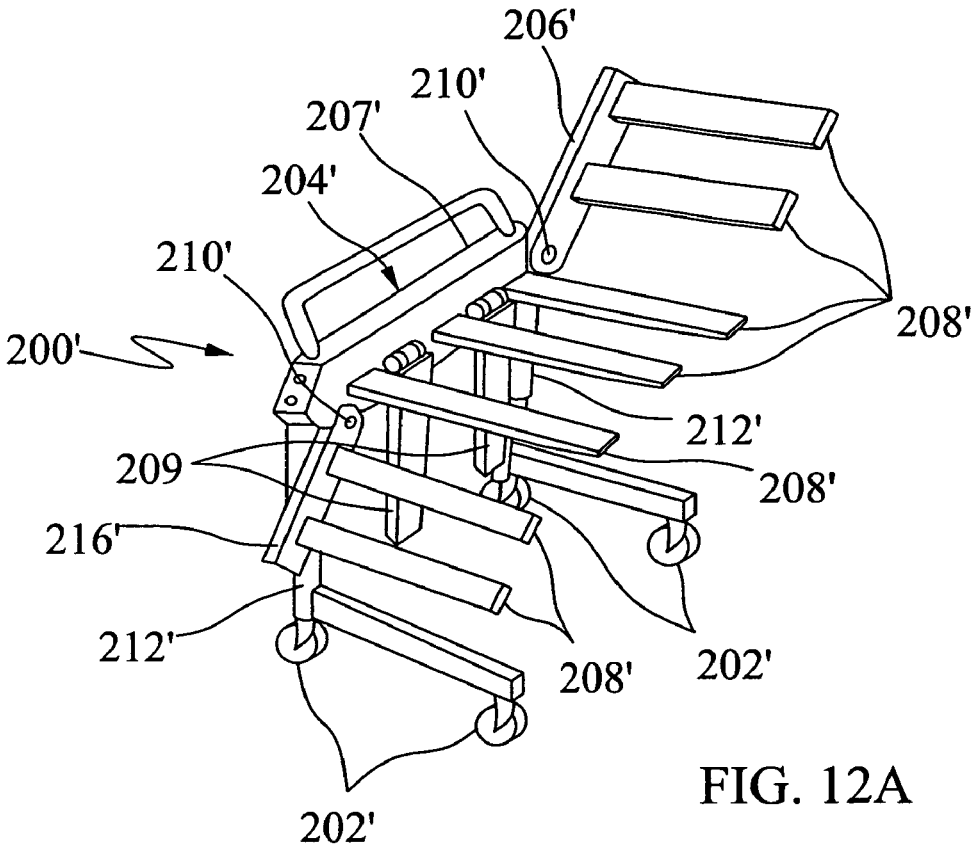
FIGS. 12 and 13 illustrate another embodiment of a transport device including tines that can be individually raised and lowered, according to an exemplary embodiment of the present invention.
Figure 12B:
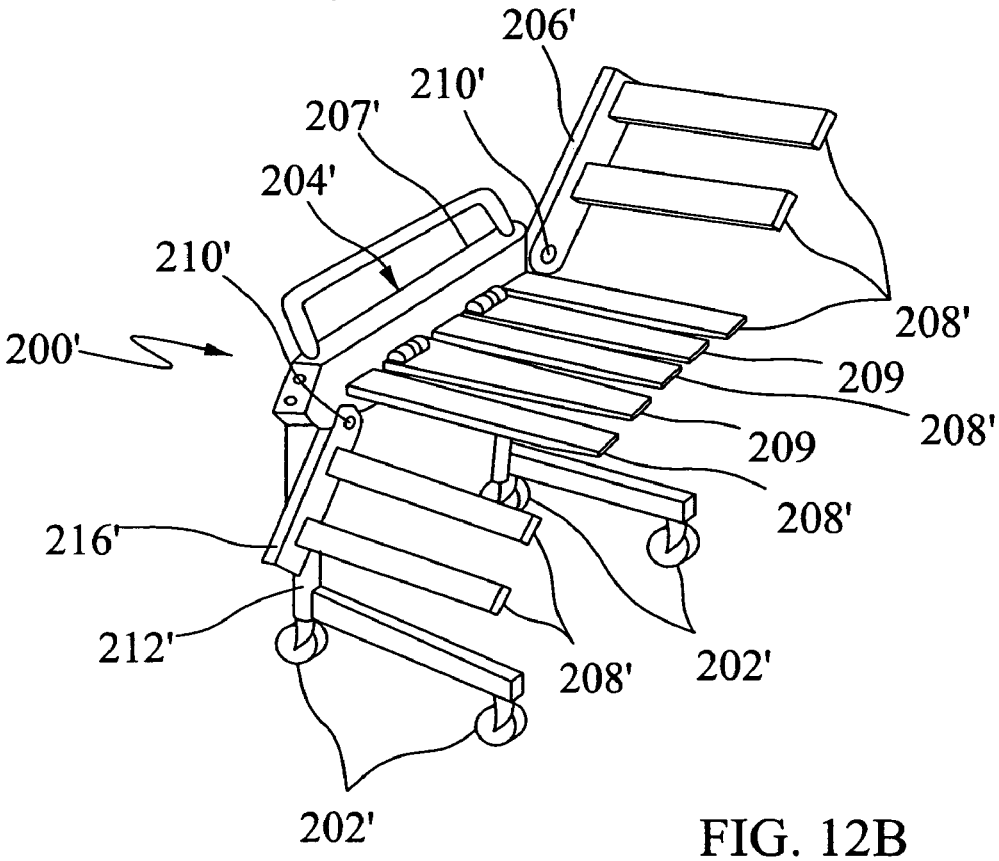

FIGS. 12A and 12B show an alternative exemplary embodiment of an extractor 200'. The extractor 200' is comprised of the same basic parts as the exemplary embodiment described above including the base frame 204', lift mechanisms 212', tines 208', torso-support frame 206', and calf-support frame 216'. The extractor 200' is supported from the floor on wheels 202'. The torso-support frame 206' and calf-support frame 216' can be pivoted about joints 210' to allow the patient to be repositioned from a supine position to a sitting position. The tines 208' are spaced to correspond with the slots 104, 104' in the patient support material 102. Folding foot rests (not shown) can be attached if desired. In this embodiment, however, pivoting tines 209 fit between the tines 208' when raised to their horizontal positions. The pivoting tines 209 can be pivoted to their horizontal orientations to provide additional support (or a substantially even surface) for a patient once he or she is extracted from a bed or other support device. When the patient is to be returned to his or her bed or other support device, the pivoting tines 209 are lowered to their vertical position.

Figure 13A:
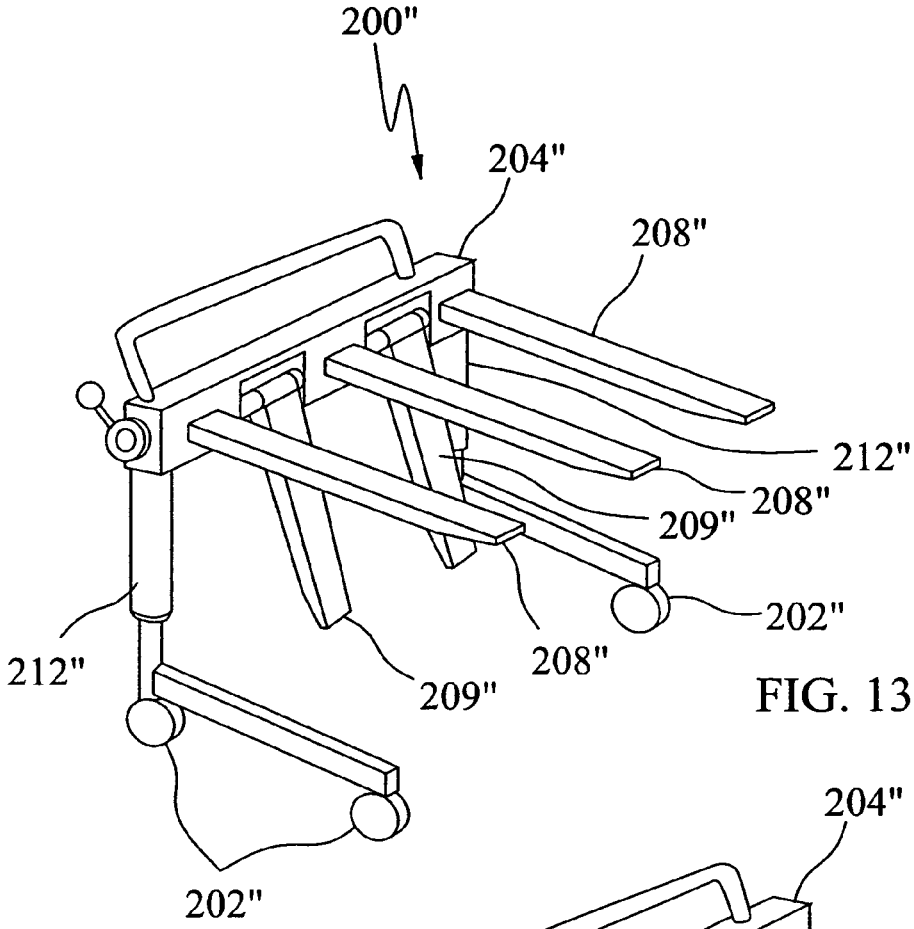
Figure 13B:
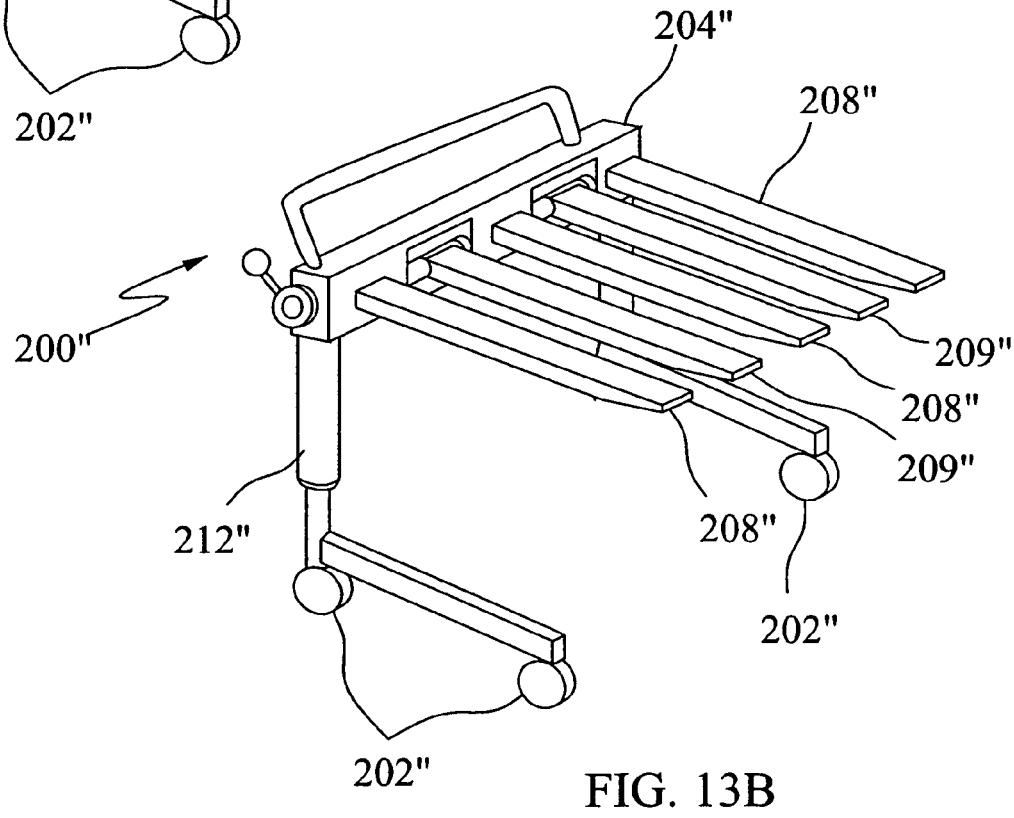

FIG. 13 illustrates a further alternative exemplary embodiment of the extractor 200". This embodiment is comprised of a frame 204", lift mechanisms 212", wheels 202", tines 208", and folding tines 209". This embodiment differs from the previously described exemplary embodiments primarily in that it does not include separate and articulatable torso-support and calf-support frames.

In a further embodiment of the invention, the extractor 200, 200', 200" can include an integrated scale (not shown), such as stress gauges built into the lift mechanisms, for measuring and displaying the patient's weight.

Figure 14:
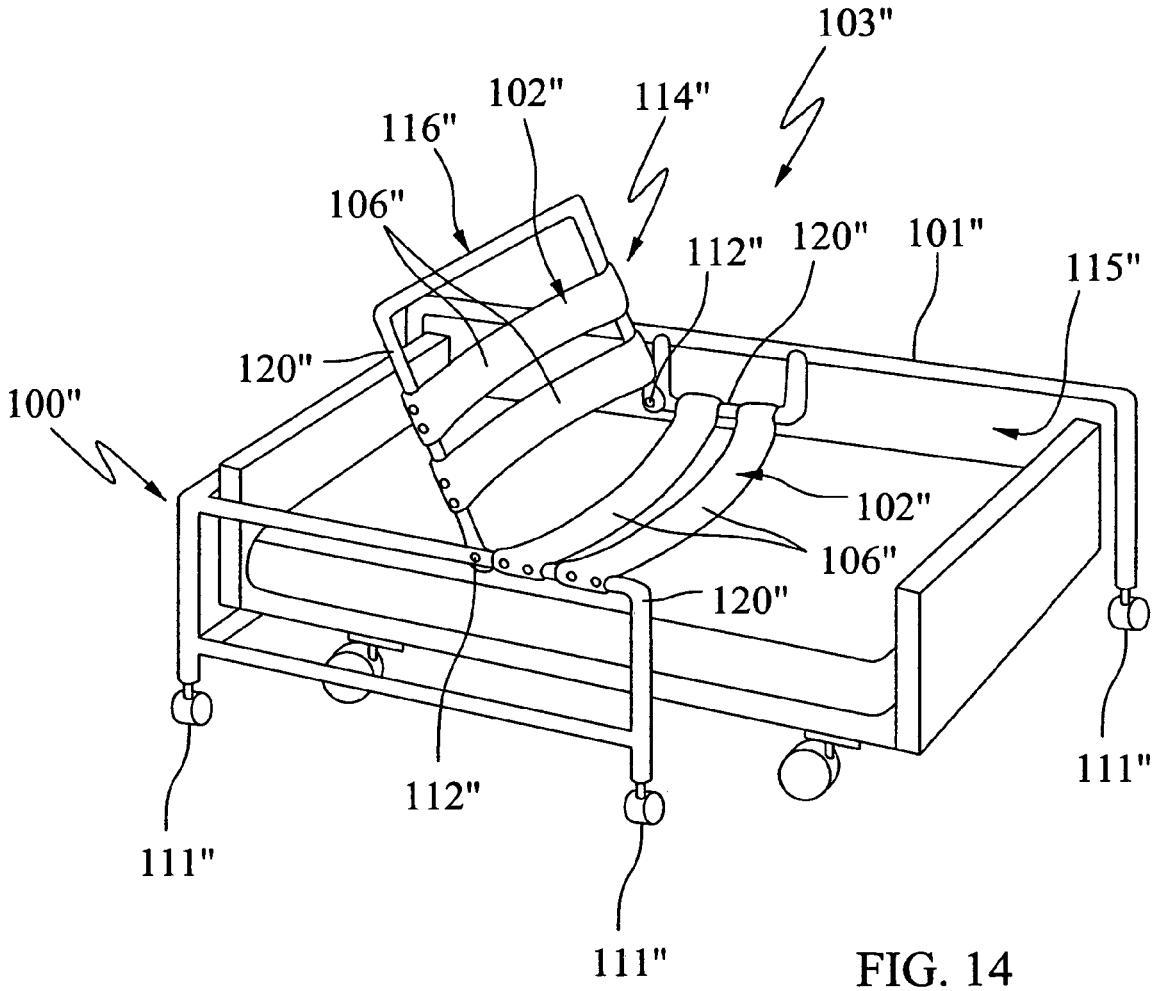
FIGS. 14 and 15 show a patient support and transfer assembly, according to another exemplary embodiment of the present invention.
Figure 15:
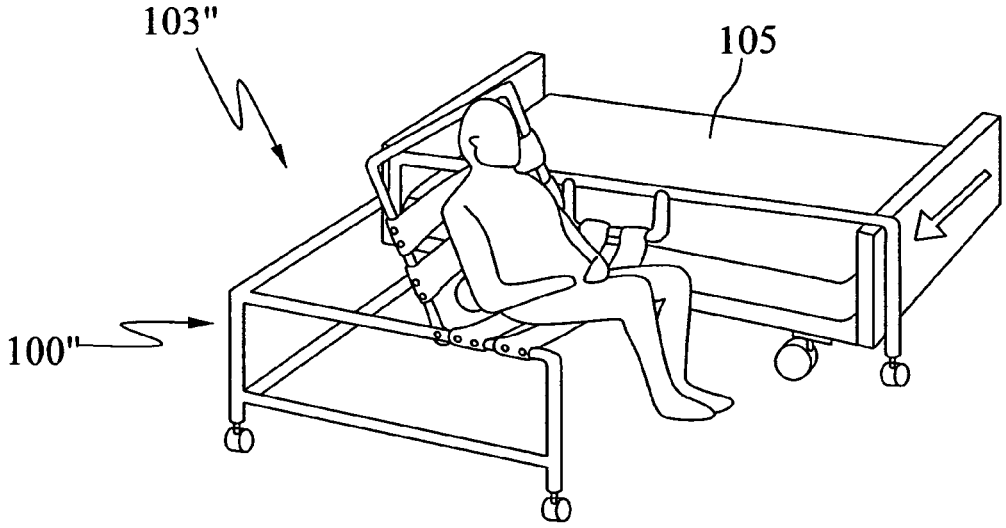

In another embodiment of the patient support assembly 103" shown in FIGS. 14 and 15, the base frame 100" has one of its longitudinal members 101" positioned above the height of the bed 105 to provide a downwardly extending gap 115" that clears the entire bed 105. This configuration allows the frame 100" to be rolled out laterally from the bed, as shown in FIG. 15. Similar to the embodiment shown in FIGS. 1 through 4, this alternative embodiment includes a patient support material 102" in the form of straps 106" extending between longitudinal bars 120" of an upper frame 114" that includes a pivoting head/chest segment 116". The hinges 112" allow the head/chest segment 116" of the frame to be raised, thus allowing a normal bed to have an inclined head/chest area like a hospital bed. This embodiment can include lift mechanisms to associated with the frame 100" to allow the frame 100" and patient support material 102" to be raised above the bed level or lowered to allow the bed to provide support for the patient, as seen with respect to the previous embodiments (similarly, the frame 100" may stay stationary while the bed itself is raised and lowered as with the previous embodiments). This embodiment does not include risers as with the above embodiments, so it is not ideal for use with the side-entry tines of the extractors 200, 200', 200" discussed above. But the slots between the straps 106" nevertheless allow for access of other elongated patient support components such as straps or support arms. As seen in FIG. 15, the patient support material 102" can be made longitudinally shorter than those shown in FIGS. 1 through 4, thus permitting the patient to more easily assume a sitting position when the frame 100" is moved from the bed. In one embodiment, the bed unit can feature a track (not shown in the drawings) to guide the frame 100" as it is rolled away from the mattress. Additionally, the upper frame 114" can be easily modified to be completely removable and reattachable to the base frame 100".

Figure 16:
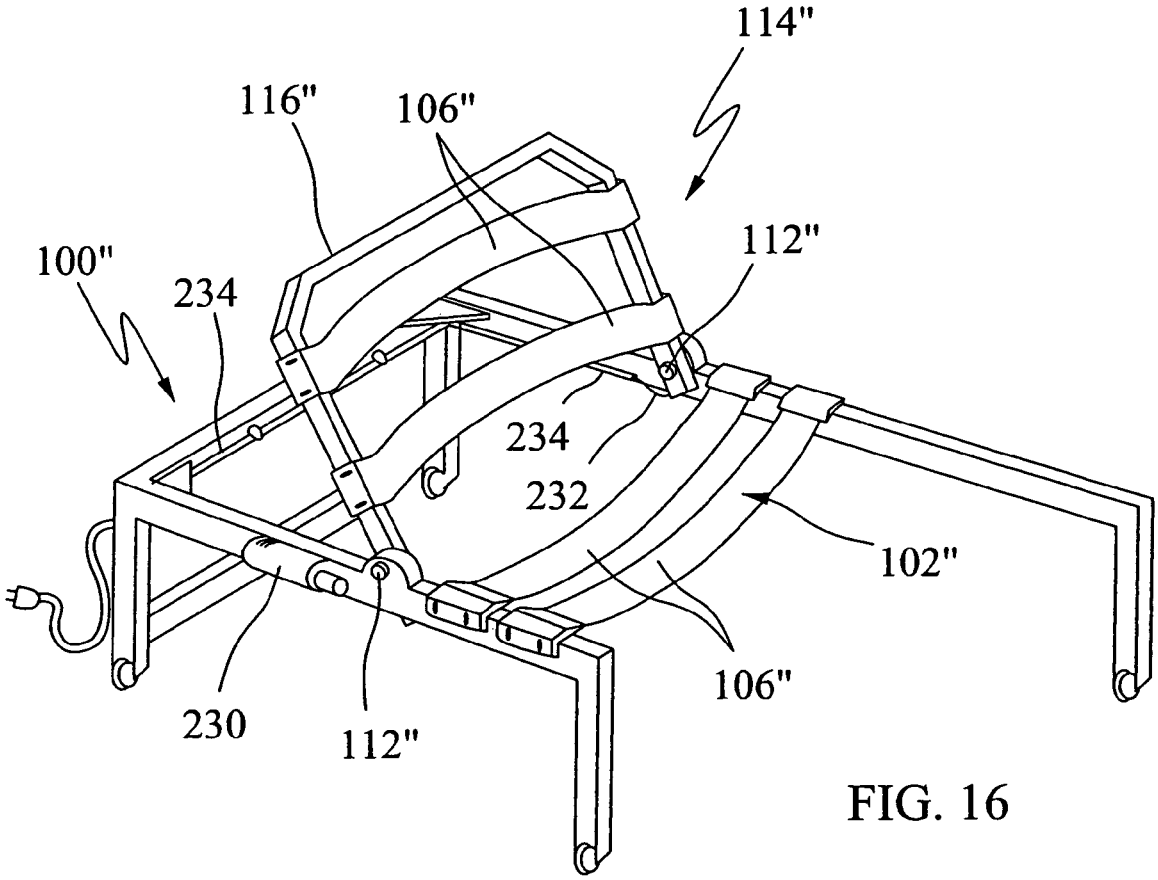
FIGS. 16 and 17 show an electric motor drive coupled by a cable to raise and lower the upper portion of the patient support assembly, according to an exemplary embodiment of the present invention.
Figure 17:
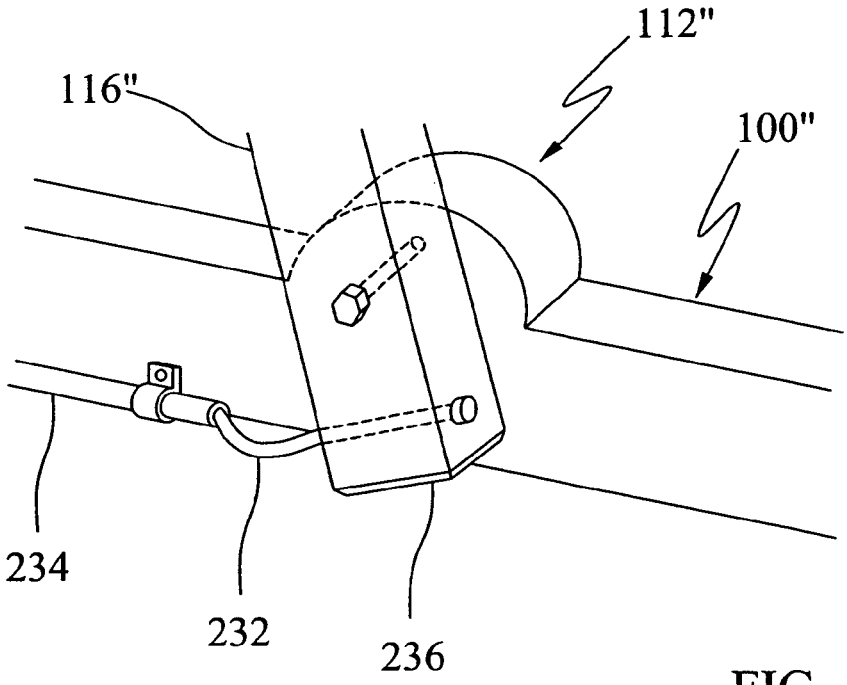

FIGS. 16 and 17 illustrate an embodiment of a motorized mechanism for selectively tilting the head/chest segment 116". An electric motor drive 230 can be adapted to apply force onto a cable 232 housed within a sheath 234. The cable can be joined to the end 236 of the head/chest segment 116" opposite the pivot point of the hinge 112". The resulting lever arm will cause the head/chest segment 116" to rotate about the hinge 112" when the cable 232 is pulled by the motor drive 230, thus causing the head/chest segment 116" to tilt. The cable 232 and sheath 234 can be routed along the frame 100", as seen in FIG. 16. This powered tilt mechanism can, of course, be employed with any of the embodiments described herein.

Figure 18:
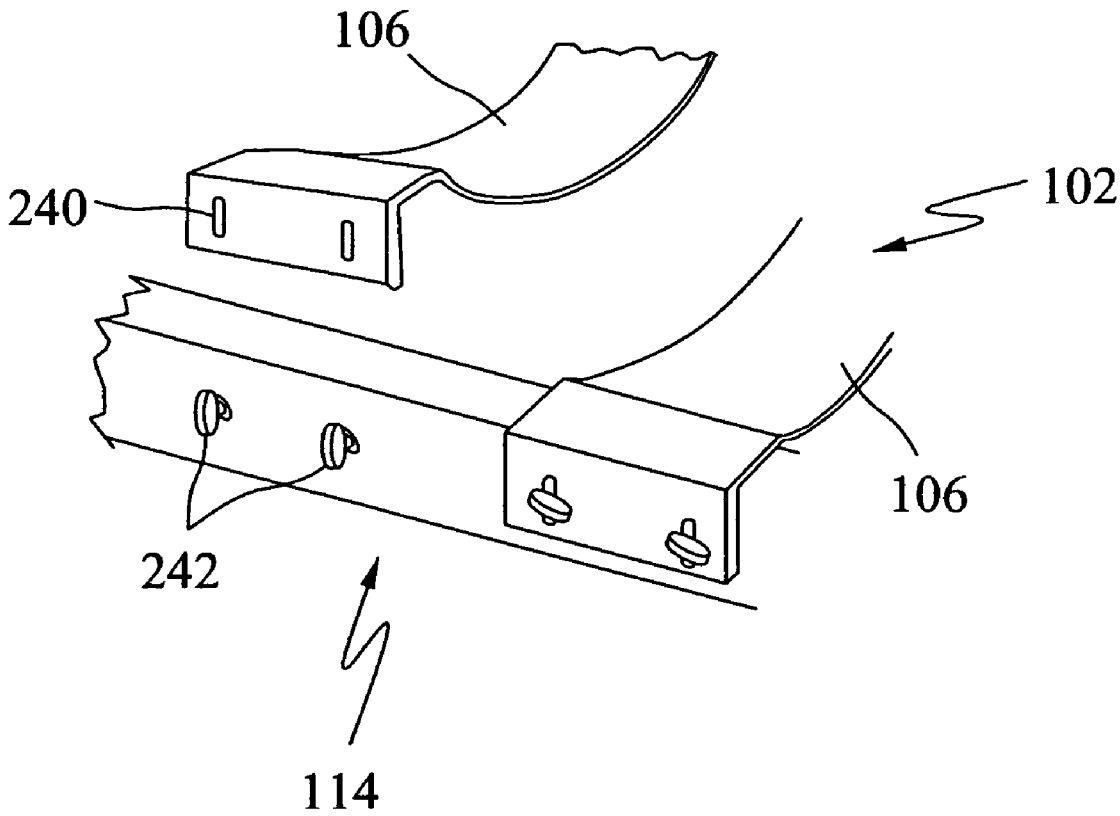
FIG. 18 shows the use of bolts to attach sheet straps to the patient support assembly, according to an exemplary embodiment of the present invention.

FIG. 18 illustrates an embodiment for coupling the patient support material 102 to the upper frame 114 along coupling points 108. The straps 106 of the patient support material 102 can be formed with holes 240 having a rectangular or other shape. The holes 240 can be shaped so that the heads of attachment bolts 242 will fit through the holes 240 when oriented along a common axis, thus allowing the sheet to be fitted over the bolts. Once the end of the straps 106 has been fitted over the bolts, the heads of the bolts 242 can be rotated so that they are no longer oriented along a common axis with the holes 240, thus holding the straps 106 securely in place on the upper frame 114, as shown in the right side of FIG. 18. This coupling design can be employed with any of the embodiments described herein. Of course, it will be appreciated by those of ordinary skill that many other mechanical coupling mechanisms may be used in place of this exemplary embodiment. For example, it is within the scope of the invention that the support material 102 be coupled to the upper frame 114 by hook and pile strips, snaps, clips, elastic bands and the like.

Figure 19:
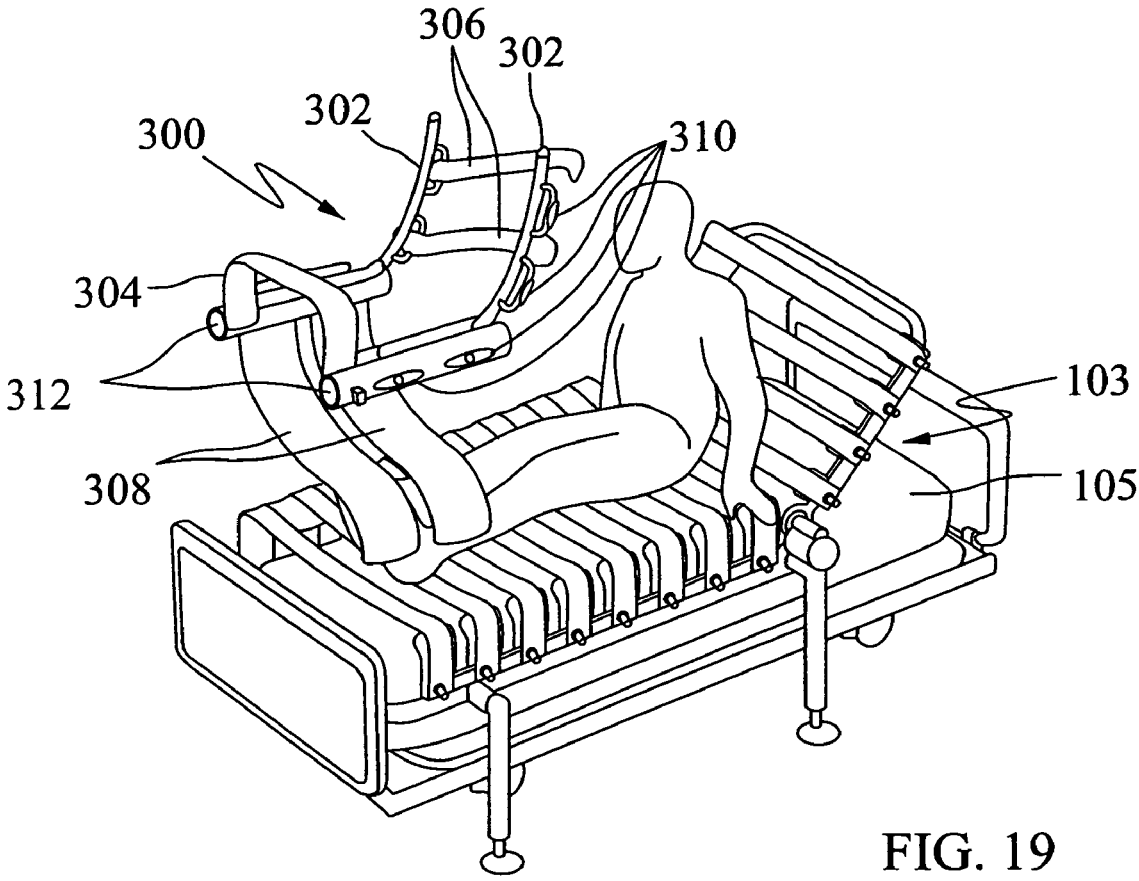
FIGS. 19 and 20 show a patient transfer frame that can be fitted around the patient and used to lift and transfer the patient from the patient support material, according to an exemplary embodiment of the present invention.

FIGS. 19-27 illustrate a further embodiment in which a patient transfer frame (or chair) is used in connection with the various patient support assemblies described above. As seen in FIG. 19, a patient transfer frame assembly 300 includes a pair of substantially rigid side bars 302 and at least one rigid cross-bar 304 extending therebetween. In the embodiment shown, the side bars 302 are substantially L-shaped so as to be adapted to approximate the curve at a patient's hips while in a seated position. One of ordinary skill in the art will appreciate that a hinge can be provided at the corners to allow the patient transfer frame 300 to reorient the patient between sitting, lying and other positions. Many other shapes and designs can also be used for the patient transfer frame assembly 300, including the various designs described in co-pending U.S. patent application Ser. No. 11/375,536, (the '536 application) the entire content of which is incorporated herein by reference. Such patient transfer frames described in detail in the '536 application are designed to: (a) provide rigidity (exoskeleton) to the human body for purposes of transferring, lifting and/or transporting the subject via a mobile device, such as a powered lift device; (b) create or provide a coupling mechanism for coupling a tine or other carriage of a lifting/mobility device thereto for the purpose of moving or lifting the subject secured to or seated on the transfer frame; and/or (c) be used as a support or frame that will interact with the body as an exoskeleton to aid with the activities of daily living.

Figure 20:
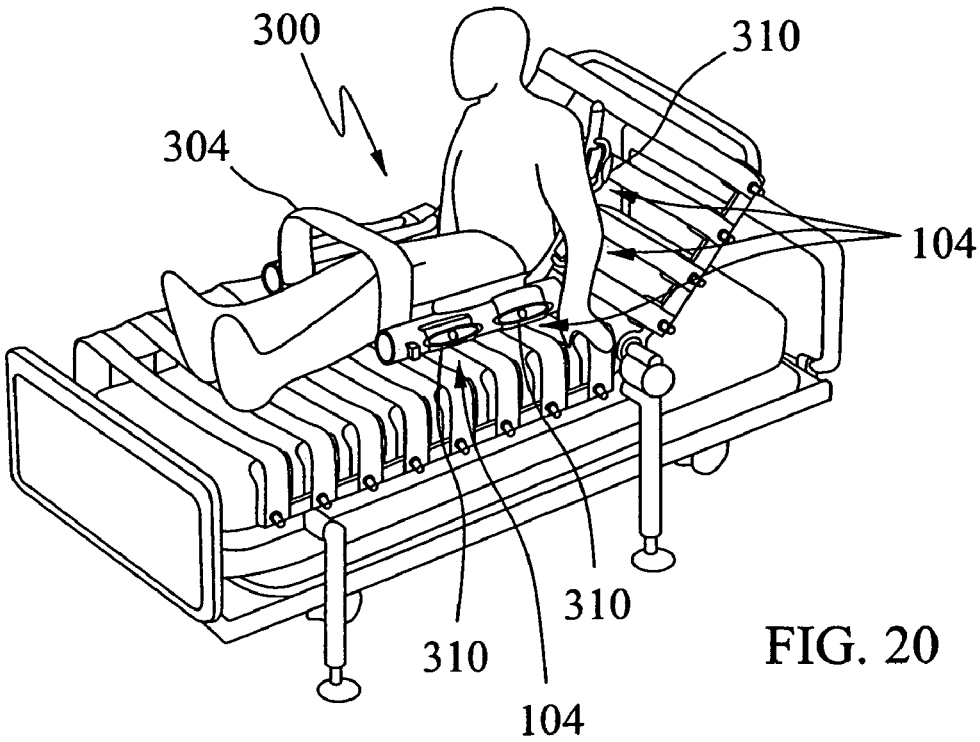

In the present exemplary embodiment, the transfer frame assembly 300 includes back-support straps 306 and thigh-support straps 308 that extend laterally between and can be selectively fastened securely to the two side bars 302. As shown in FIG. 20, the straps 306 can be routed behind the patient's back, while the straps 308 can be routed beneath the patient's legs and buttocks while the patient is resting on the patient support assembly 103. When the patient is resting on the patient support assembly 103, the straps can be routed in the slots 104 in the patient support material 102 beneath the patient. The straps 306 and 308 can then be fastened to attachment points 310 on the opposing side bars 302, securely holding the straps in place. The leading ends of the side bars 302 include receptacles 312 adapted to be coupled to tines of a lift cart as will be described below.

Figure 21:
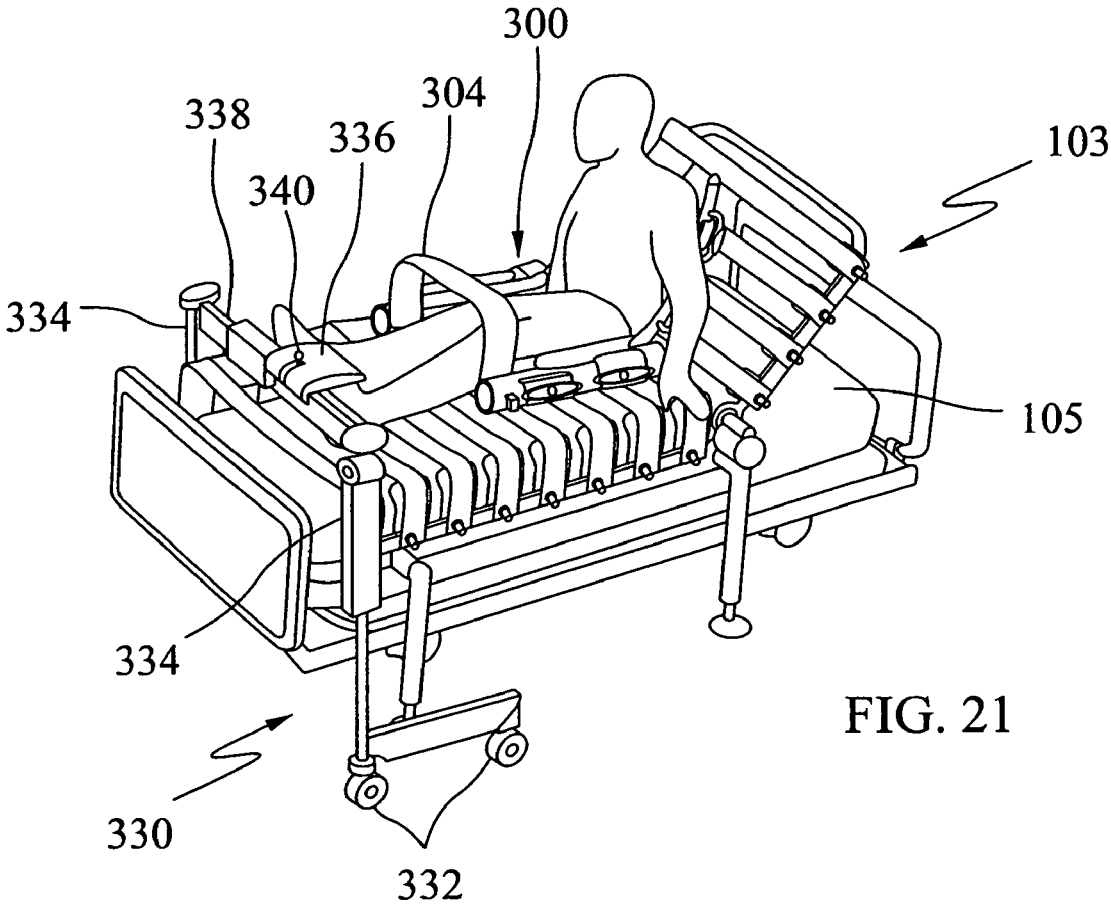
FIGS. 21 through 23 show an extensible patient transfer device that can be used to lift and move the patient in the patient transfer frame from the patient support material, according to an exemplary embodiment of the present invention.

Once the patient has been strapped into the patient transfer frame assembly 300, the patient can be moved by a transport device that is coupled to the patient transfer frame assembly 300. In an exemplary embodiment, an extensible bed extractor can be used. FIG. 21 shows an extensible bed extractor 330 according to an exemplary embodiment which comprises an elevated horizontal beam 338 and two vertical lift units 334 supporting the beam 338 from the floor. The beam 338 of the present embodiment can be laterally extended and collapsed; and, therefore, one of the vertical lift units 334 includes wheels 332. Mounted to the beam 338 is an attachment carriage 336 with a locking mechanism 340. The attachment carriage 336 includes a coupling mechanism (not shown) adapted to be coupled to a complimentary coupling mechanism (also not shown) on the rigid cross bar 304. The attachment carriage 336 can be moved along the beam 338. The lift units 334 can be operated hydraulically, pneumatically, by a motorized mechanism, manually, or by any other means capable of raising and lowering the beam 338.

Figure 22:
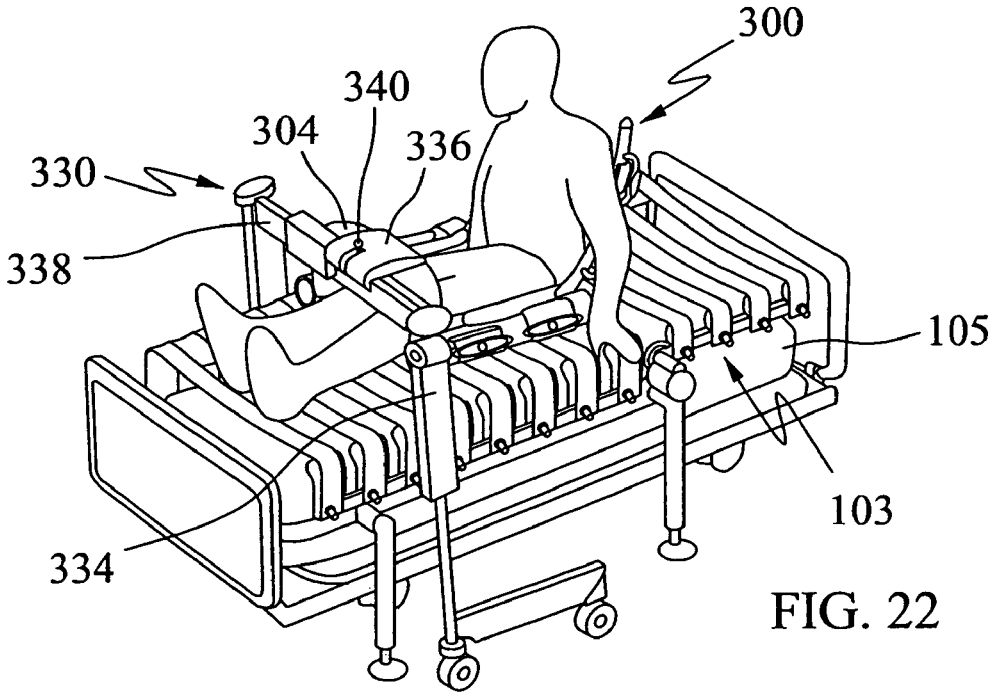
Figure 23:
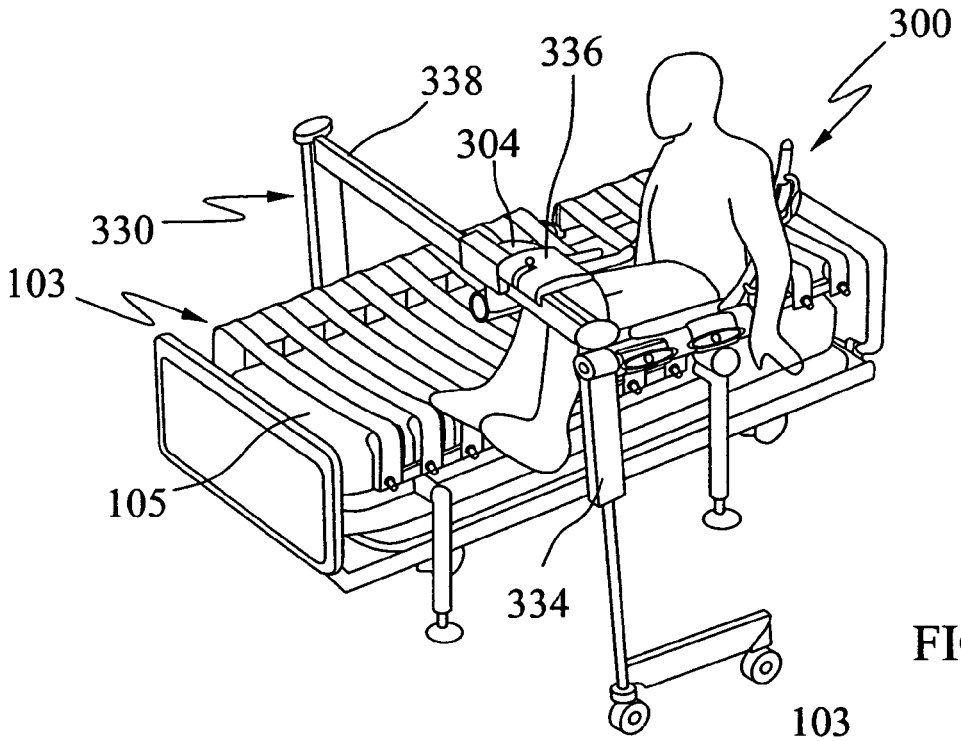

FIG. 22 shows the extensible bed extractor 330 attached to the transfer frame assembly 300 seating a patient. To use the extensible bed extractor 330, the patient is first placed into the transfer frame assembly 300 as described above. The extensible bed extractor 330 is maneuvered near the patient such that the attachment couplings on the rigid cross-bar 304 and the attachment carriage are coupled together and locked using the locking mechanism 340. The patient in the transfer frame 300 is lifted using the lift units 334. As shown in FIG. 23, the beam 338 is extended and the patient is moved horizontally by sliding the carriage 336 along the beam 338 to move the patient to a position above the desired destination (e.g., a chair, wheelchair, scooter, commode, etc.). The patient is then lowered using the lift units 334, the locking mechanism 340 is released, and the attachment coupling is removed from the carriage 336. The extensible bed extractor 330 can then be moved away and the beam 336 collapsed again if desired.

Figure 24:
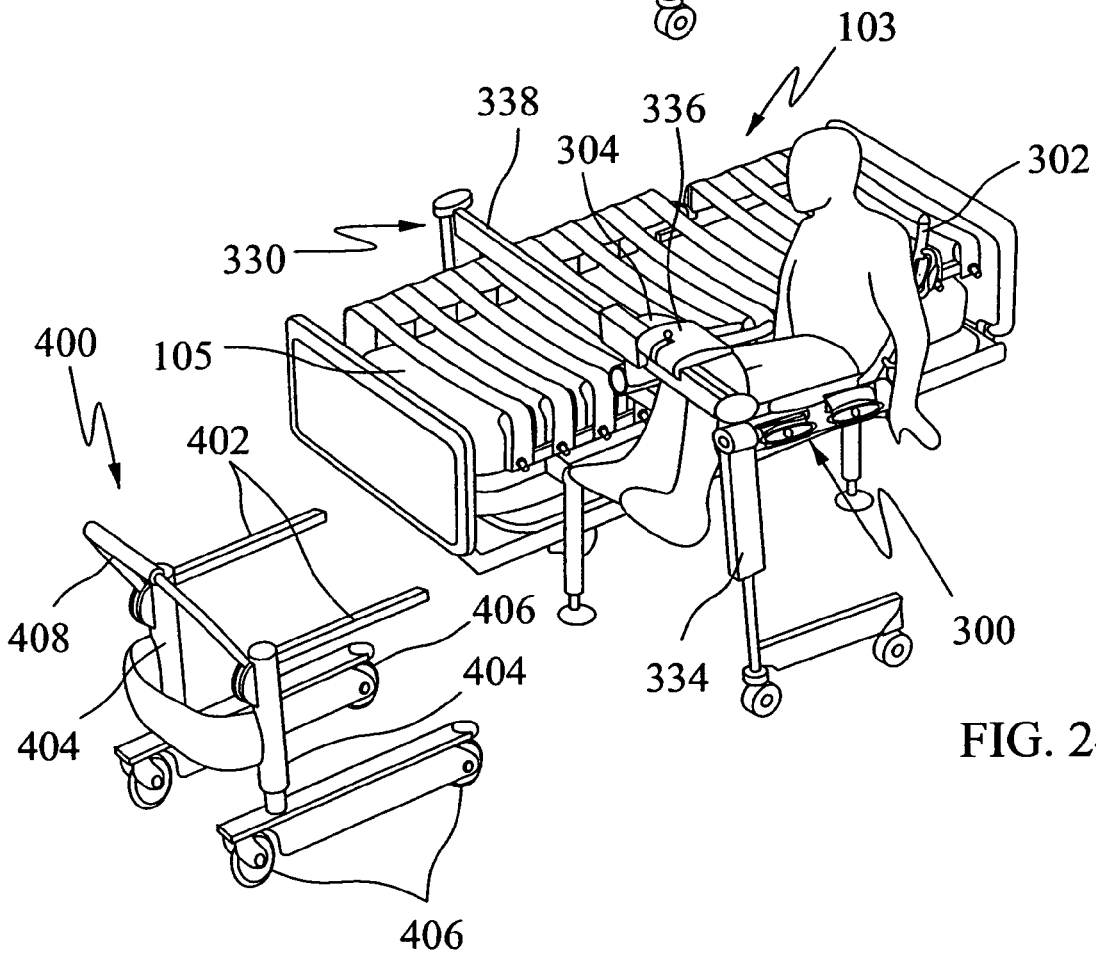
FIGS. 24 through 27 show a fork cart that can be used to transport the patient in the patient transfer frame, according to an exemplary embodiment of the present invention.

FIG. 24 shows a lift cart 400 which includes tines 402. The tines 402 can be raised and lowered using the lift mechanisms 404 which are supported from the floor by wheels 406. The lift mechanisms 404 can be operated hydraulically, pneumatically, by a motorized mechanism, manually, or by any other means capable of raising and lowering the forks 402. The lift cart 400 is moved using the handle 408. The tines 402 of the lift cart 400 are adapted to be received within and coupled to receptacles 312 provided in the leading ends of the side bars 302 of the patient transfer frame 300.

Figure 25:
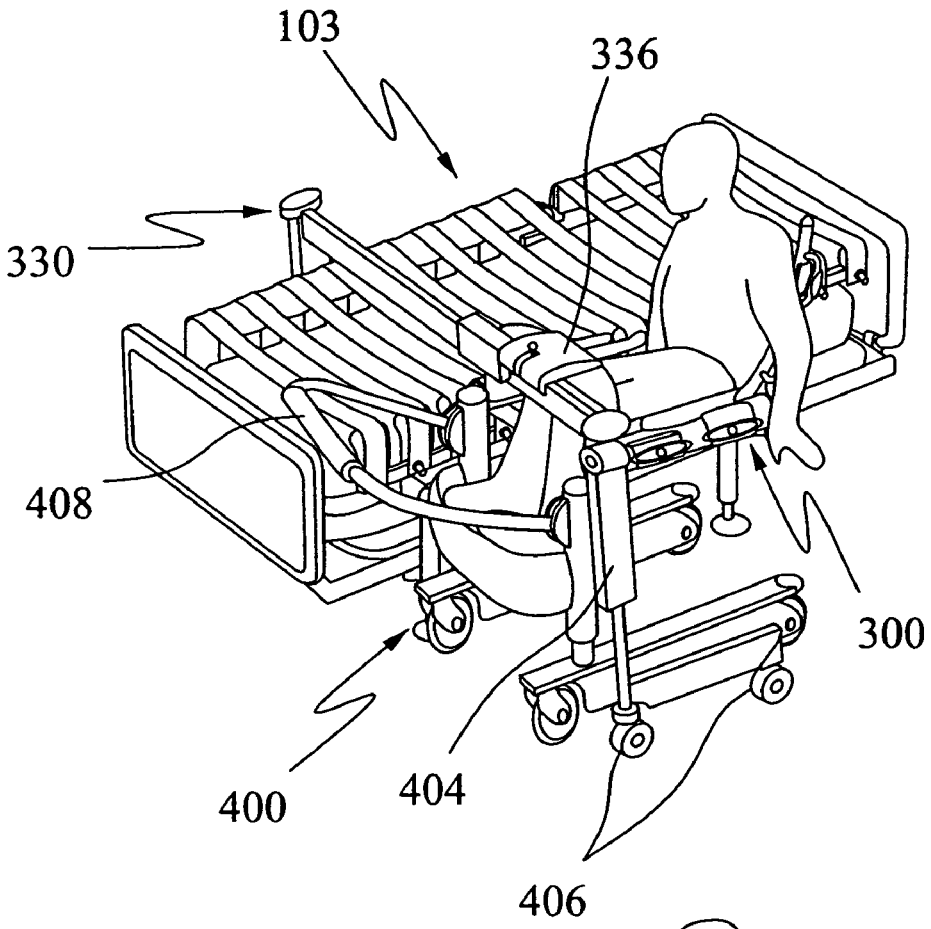
Figure 26:
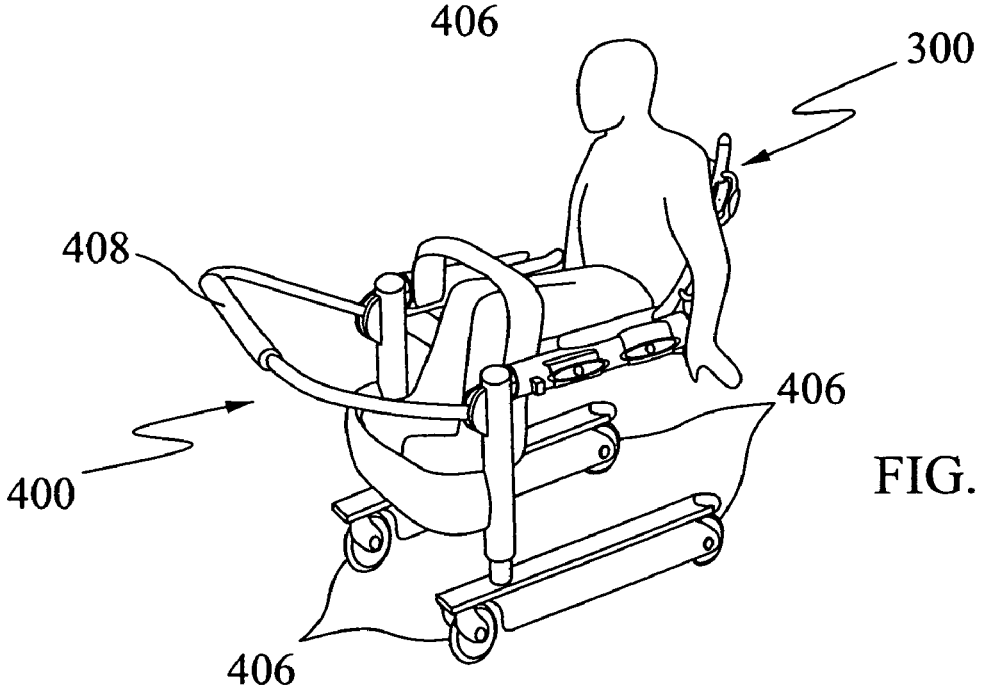

As seen in FIGS. 24 and 25, once the patient has been removed from the bed using the extensible bed extractor 330, the lift units 334 on the extensible bed extractor can be used to lower the patient to the approximate level of the tines 402 of the lift cart 400. The lift mechanisms 404 on the lift cart 400 can then be used to position the tines 402 at the correct height to mate with lateral receptacles 312 of the transfer frame assembly 300 in which the patient is seated, as seen in FIG. 25. Thereafter, the transfer frame assembly 300 can be decoupled from the carriage 336 of the extensible bed extractor 330 and the lift cart 400 can then be moved away from the bed and the extensible bed extractor carrying the transfer frame assembly 300 and the patient. The patient can be easily transported by an attendee using the handle 408 to push the lift cart 400 on its wheels 406, as seen in FIG. 26.

Figure 27:
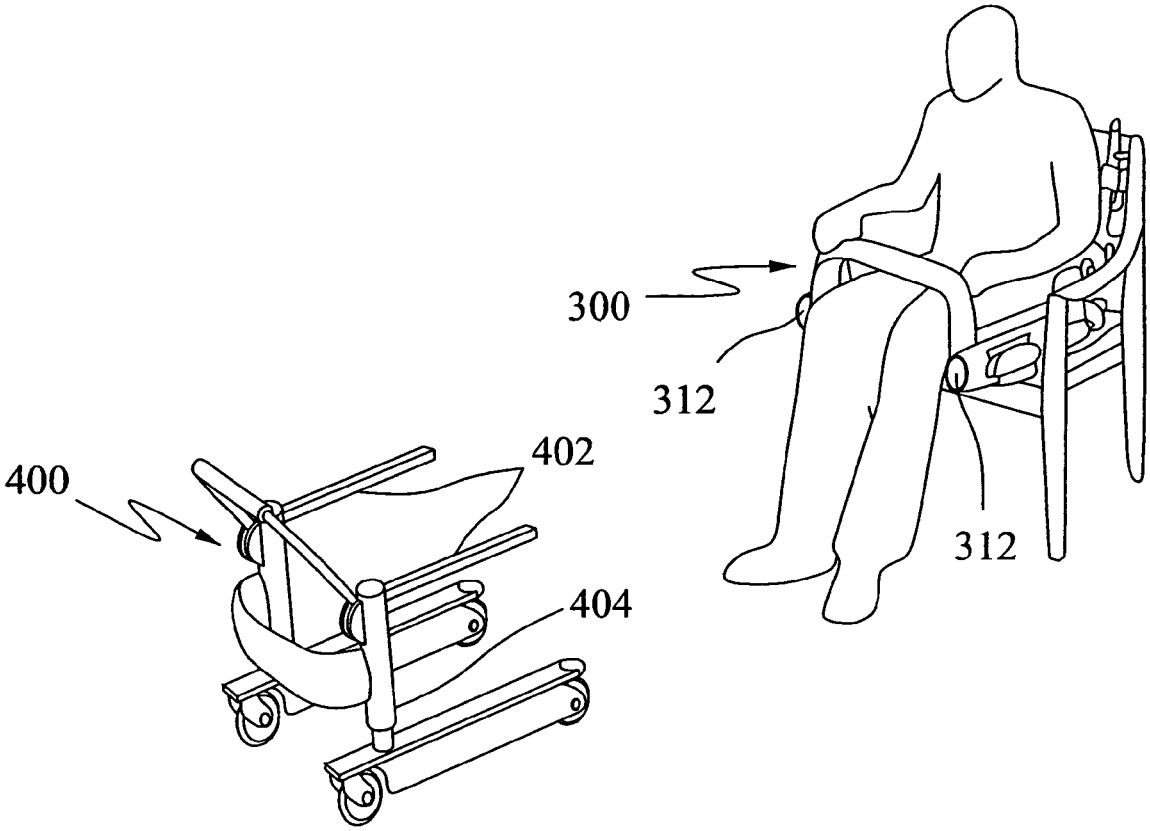

Using the lift cart 400 as a transport device, the patient can be placed above a chair, wheelchair, commode, etc. onto which the he or she is to be deposited. The patient can be lowered using the lift cart's lift mechanisms 404. Once the patient has been lowered and is supported by a chair or other support device, the lift cart 400 can be backed up so that the tines 402 are removed from the receptacles 312 in the patient's transfer frame assembly 300. FIG. 27 shows the patient resting in a chair and the lift cart 400 removed from the patient's frame assembly 300.

While the exemplary embodiment utilizes tines 402 and receptacles 312 as the coupling mechanisms, it will be appreciated that alternate coupling mechanisms may be used and fall within the scope of the invention. It will be further appreciated that alternate lift carts and patient transfer devices disclosed in the '536 application can be used in place of the lift cart 400 described above. Some of such alternate lift carts may be motorized and include user controls for the motor and steering, where such user controls may be repositionable between and an attendee control orientation and a patient control orientation.

Having described the invention with reference to exemplary embodiments, it is to be understood that the invention is defined by the claims and it is not intended that any limitations or elements describing the exemplary embodiment set forth herein are to be incorporated into the meanings of the claims unless such limitations or elements are explicitly listed in the claims. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A device to assist in patient care comprising:

a substantially rigid frame defining a patient-support area within an area bounded by the frame, the frame being adapted to be positioned with respect to a patient bed such that the patient support area substantially lies on a plane substantially parallel to a plane of an upper patient receiving surface of the bed; and a patient support material mounted to the frame so as to extend within the patient support area of the frame, the patient support material having at least two openings extending laterally inward from at least one side of the patient support material and oriented substantially perpendicular to a line running from the head of the bed to the foot of the bed;

wherein the openings allow at least two respective elongated patient transfer components of a transfer device to be inserted beneath a patient lying on the patient support material such that the elongated patient transfer components can be lifted above through the openings and thus transfer the patient from the patient support material to the elongated patient transfer components; and wherein the patient support material includes a plurality of straps extending laterally across the patient-support area, the straps defining the openings between adjacent straps.

2. The device of claim 1, wherein the frame comprises two or more sections pivotally joined together along a hinged lateral axis.

3. The device of claim 2, wherein the patient support material comprises two or more sections, each of which is respectively mounted to one of the sections of the frame, and each section of the patient support material having at least one opening to allow an elongated patient transfer component of the transfer device to be inserted beneath the patient lying on the patient support material.

4. The device of claim 2, further comprising:

an elevator mechanism associated with the frame, the elevator mechanism including an actuator that, upon actuation of the actuator, vertically lifts the frame such that the patient support material is elevated above the bed.

5. The device of claim 4, wherein the elevator mechanism utilizes at least one of manual, electric, hydraulic, and pneumatic application of force.

6. The device of claim 1, wherein the frame is elevated from the floor upon a wheeled base.

7. The device of claim 6, wherein the frame includes a downwardly facing gap that extends laterally across the bed, such that the frame can be translationally moved relative to the bed, at least a portion of the bed being cleared by the gap.

8. A device to assist in patient care comprising:

a substantially rigid frame defining a patient-support area within an area bounded by the frame, the frame being adapted to be positioned with respect to a patient bed such that the patient support area substantially lies on a plane substantially parallel to a plane of an upper patient receiving surface of the bed; and a patient support material mounted to the frame so as to extend within the patient support area of the frame, the patient support material having at least two openings extending laterally inward from at least one side of the patient support material and oriented substantially perpendicular to a line running from the head of the bed to the foot of the bed;

wherein the openings allow at least two respective elongated patient transfer components of a transfer device to be inserted beneath a patient lying on the patient support material such that the elongated patient transfer components can be lifted above through the openings and thus transfer the patient from the patient support material to the elongated patient transfer components;

wherein the frame includes:

at least a pair of parallel, longitudinally extending rigid bars defining lateral sides of the patient-support area; and at least one riser extending vertically from each of the longitudinally extending rigid bars; and wherein the patient support material is releasably attached to the frame approximate the longitudinally extending rigid bars and extends up over the risers so as to be elevated from the longitudinally extending rigid bars.

9. A device to assist in patient care comprising:

a substantially rigid frame defining a patient-support area within an area bounded by the frame, the frame being adapted to be positioned with respect to a patient bed such that the patient support area substantially lies on a plane substantially parallel to a plane of an upper patient receiving surface of the bed; and a patient support material mounted to the frame so as to extend within the patient support area of the frame, the patient support material having at least two openings extending laterally inward from at least one side of the patient support material and oriented substantially perpendicular to a line running from the head of the bed to the foot of the bed;

wherein the openings allow at least two respective elongated patient transfer components of a transfer device to be inserted beneath a patient lying on the patient support material such that the elongated patient transfer components can be lifted above through the openings and thus transfer the patient from the patient support material to the elongated patient transfer components; and wherein the openings of said patient support material include a resilient material extending therein, the resilient material being joined to a relatively less resilient material forming the patient support material areas bounding adjacent openings.

10. The device of claim 9, wherein the resilient material can stretch downwardly to allow elongated transfer components of the transfer device to slide under the patient.

11. A transport system to assist in patient care comprising:

a patient support assembly including a patient support surface, the patient support assembly including at least two openings extending laterally inward from a side of the patient support surface; and a transport device including:

(a) a base unit;

(b) an extraction-frame unit joined to the base unit by a lifting mechanism adapted to move the extraction-frame unit translationally at least in a substantially vertical direction with respect to the base unit;

(c) at least two tines extending substantially horizontally from the extraction frame unit; and (d) at least one folding tine joined to the extraction-frame unit, selectively foldable into and out of a substantially horizontal patient support orientation;

wherein the tines can respectively fit into the at least two openings of the patient support assembly, thus allowing the tines to be inserted beneath a patient lying on the patient support surface such that the tines can be lifted above through the openings and thus transfer the patient from the patient support surface to the tines.

12. The transport system of claim 11, wherein the base unit includes a plurality of wheels such that the base unit can be moved by rolling.

13. The transport system of claim 11, wherein the extraction-frame unit includes a first torso-support frame portion and a second thigh-support frame portion, the first and second frame portions being pivotally joined together along a hinged axis.

14. The transport system of claim 11, wherein the lifting mechanism of the transport device operates using at least one of manual, electric, hydraulic, and pneumatic application of force.

15. A transport system to assist in patient care comprising:

a patient support assembly including a patient support surface, the patient support assembly including at least two openings extending laterally inward from a side of the patient support surface; and a transport device including:

(a) a base unit;

(b) an extraction-frame unit joined to the base unit by a lifting mechanism adapted to move the extraction-frame unit translationally at least in a substantially vertical direction with respect to the base unit; and (c) at least two tines extending substantially horizontally from the extraction frame unit;

wherein the tines can respectively fit into the at least two openings of the patient support assembly, thus allowing the tines to be inserted beneath a patient lying on the patient support surface such that the tines can be lifted above through the openings and thus transfer the patient from the patient support surface to the tines;

wherein the extraction-frame unit includes a first torso-support frame portion and a second thigh-support frame portion, the first and second frame portions being pivotally joined together along a hinged axis;

wherein the second thigh-support frame portion includes at least two tines extending substantially horizontally from the second thigh-support frame portion; and wherein the first torso-support frame portion includes one or more tines extending substantially horizontally from the first torso-support frame portion.

16. A transport system to assist in patient care comprising:

a patient support assembly including a patient support surface, the patient support assembly including at least two openings extending laterally inward from a side of the patient support surface; and a transport device including:

(a) a base unit;

(b) an extraction-frame unit joined to the base unit by a lifting mechanism adapted to move the extraction-frame unit translationally at least in a substantially vertical direction with respect to the base unit; and (c) at least two tines extending substantially horizontally from the extraction frame unit;

wherein the tines can respectively fit into the at least two openings of the patient support assembly, thus allowing the tines to be inserted beneath a patient lying on the patient support surface such that the tines can be lifted above through the openings and thus transfer the patient from the patient support surface to the tines;

wherein the extraction-frame unit includes a first torso-support frame portion and a second thigh-support frame portion, the first and second frame portions being pivotally joined together along a hinged axis; and wherein the first torso-support frame portion can be pivoted between at least a partially vertical position, whereby the transport device can support the patient in a sitting position, and an approximately horizontal position, whereby the transport device can support the patient in a supine position.

17. The transport system of claim 16, further comprising removable cushions that can be fitted to the first and second frame portions.

18. The transport system of claim 16, wherein the base unit includes at least one motor driven wheel, providing motorized movement of the base unit.

19. The transport system of claim 18, wherein the transport device further includes user controls for controlling the motorized movement of the base unit.

20. The transport system of claim 19, wherein the user controls are capable of being reoriented between a patient-control orientation and an assistant-control orientation.

21. A transport system to assist in patient care comprising:

a patient support assembly including a patient support surface, the patient support assembly including at least two openings extending laterally inward from a side of the patient support surface; and a transport device including:

(a) a base unit;

(b) an extraction-frame unit joined to the base unit by a lifting mechanism adapted to move the extraction-frame unit translationally at least in a substantially vertical direction with respect to the base unit; and (c) at least two tines extending substantially horizontally from the extraction frame unit;

wherein the tines can respectively fit into the at least two openings of the patient support assembly, thus allowing the tines to be inserted beneath a patient lying on the patient support surface such that the tines can be lifted above through the openings and thus transfer the patient from the patient support surface to the tines;

wherein the extraction-frame unit includes a first torso-support frame portion, a second thigh-support frame portion, the first and second frame portions being pivotally joined together along a hinged axis, and a third below-knee support frame portion pivotally joined to the second thigh-support frame portion along a hinged axis.

22. The transport system of claim 21, wherein the third below-knee support frame portion includes one or more substantially parallel tines extending substantially horizontally from the third below-knee support frame portion.

23. The transport system of claim 22, wherein the third frame portion can be pivoted between at least a partially vertical position, whereby the transport device can support the patient in a sitting position, and an approximately horizontal position, whereby the transport device can support the patient in a supine position.

24. A transport system to assist in patient care comprising:

a patient support assembly including a patient support surface, the patient support assembly including at least two openings extending laterally inward from a side of the patient support surface; and a transport device including:

(a) a base unit;

(b) an extraction-frame unit joined to the base unit by a lifting mechanism adapted to move the extraction-frame unit translationally at least in a substantially vertical direction with respect to the base unit; and (c) at least two tines extending substantially horizontally from the extraction frame unit;

wherein the tines can respectively fit into the at least two openings of the patient support assembly, thus allowing the tines to be inserted beneath a patient lying on the patient support surface such that the tines can be lifted above through the openings and thus transfer the patient from the patient support surface to the tines; and wherein the transport device includes a weight detector that is adapted to measure the patient's weight.

25. A transport system to assist in patient care comprising:

a patient support assembly including a patient support surface, the patient support assembly including at least two openings extending laterally inward from a side of the patient support surface; and a transport device including:

(a) a base unit;

(b) an extraction-frame unit joined to the base unit by a lifting mechanism adapted to move the extraction-frame unit translationally at least in a substantially vertical direction with respect to the base unit; and (c) at least two tines extending substantially horizontally from the extraction frame unit;

wherein the tines can respectively fit into the at least two openings of the patient support assembly, thus allowing the tines to be inserted beneath a patient lying on the patient support surface such that the tines can be lifted above through the openings and thus transfer the patient from the patient support surface to the tines; and wherein at least one tine is selectively removable from the extraction-frame unit.

26. A patient transfer system to assist in patient care comprising:

a patient support assembly including a patient support surface, the patient support assembly including at least one laterally extending opening extending into the patient support surface; and a patient transfer device including a patient transfer frame, the patient transfer frame including an elongated transfer component adapted to be inserted laterally into the opening beneath the patient;

wherein the patient transfer frame includes at least two side bars; at least one rigid cross bar joined to the side bars; at least one patient support strap adapted to be fastened to and extend between the side bars, the at least one strap providing the elongated transfer component; and at least one first coupling component provided on the patient transfer frame and adapted to be coupled to a first complementary coupling component of a first patient lift device.

27. The patient transfer system of claim 26, further comprising:

a first patient lift device including, a base assembly, a beam joined to the base assembly and adapted to extend over a patient bed, the first complementary coupling component, adapted to be coupled to the first coupling component of the patient transfer frame, provided on the beam, and a lift mechanism implemented in the base unit for raising the beam;

wherein the first patient lift device can be coupled to the patient transfer frame and used to lift the patient from the bed.

28. The patient transfer system of claim 27, wherein the first complementary coupling component is provided on a carriage riding on the beam.

29. The patient transfer system of claim 28, wherein the carriage is selectively translatable along the beam.

30. The patient transfer system of claim 26, wherein the patient transfer frame includes a second coupling component adapted to be coupled to a second complimentary coupling component of a patient mobility device.

31. The patient transfer system of claim 30, further comprising:

a patient mobility device having a wheeled base unit and the second complimentary coupling component adapted to be coupled to the second coupling component of the patient transfer frame, wherein the patient transfer frame rides on the wheeled base unit when coupled.

32. A patient transfer system to assist in patient care comprising:

a patient support assembly including a patient support surface, the patient support assembly including at least one laterally extending opening extending into the patient support surface; and a patient transfer device including a patient transfer frame, the patient transfer frame including an elongated transfer component adapted to be inserted laterally into the opening beneath the patient;

wherein the patient transfer frame includes at least two side bars; at least one rigid cross bar joined to the side bars; the elongated transfer component; and at least one first coupling component provided on the patient transfer frame and adapted to be coupled to a first complementary coupling component of a first patient lift device.

33. A method of transporting a patient, comprising the steps of:

providing a substantially rigid frame defining a patient-support area within an area bounded by the frame, the frame being adapted to be positioned with respect to a patient bed such that the patient support area substantially lies on a plane substantially parallel to a plane of an upper patient receiving surface of the bed;

providing a patient support material mounted to the frame so as to extend within the patient support area of the frame, the patient support material having at least two openings extending laterally inward from at least one side of the patient support material and oriented substantially perpendicular to a line running from the head of the bed to the foot of the bed;

inserting at least two tines of a transport device into the openings in the patient support material beneath the patient lying on the patient support material; and lifting the tines of the transport device through the openings such that the patient is supported by the tines and not by the patient support material.

34. The method of claim 33, further comprising the steps of:

moving the transport device away from the bed such that the tines of the transport device are no longer positioned over the bed and the patient support material; and moving the transport device to a desired location.

35. The method of claim 33, further comprising the step, prior to the inserting step, of increasing the vertical distance between the patient support material and the bed such that the patient is supported by the patient support material and not by the bed.

36. The method of claim 33, further comprising the step, prior to the inserting step, of moving the frame defining a patient-support area away from the bed such that the patient is supported by the patient support material and not by the bed.

37. A method of transporting a patient, comprising the steps of:

providing a substantially rigid frame defining a patient-support area within an area bounded by the frame, the frame being adapted to be positioned with respect to a patient bed such that the patient support area substantially lies on a plane substantially parallel to a plane of an upper patient receiving surface of the bed;

providing a patient support material mounted to the frame so as to extend within the patient support area of the frame, the patient support material having at least one opening extending laterally inward from at least one side of the patient support material and oriented substantially perpendicular to a line running from the head of the bed to the foot of the bed;

placing a patient transfer frame about the patient's body, the patient transfer frame having at least two side bars, a rigid cross bar joined to the side bars, at least one strap adapted to extend laterally between and be fastened to the side bars, and at least one coupling component provided on the patient transfer frame and adapted to be coupled to a complementary coupling component of a patient transfer device;

routing the at least one strap through the at least one opening in the patient support material under the patient and fastening the strap laterally between the side bars of the patient transfer frame;

coupling the complementary coupling component of the first patient transfer device to the coupling component provide on the patient transfer frame;

moving the patient and the patient transfer frame away from the bed using the first patient transfer device.

38. The method of claim 37, further comprising the step, prior to the routing step, of increasing the vertical distance between the patient support material and the bed such that the patient is supported by the patient support material and not by the bed.

39. The method of claim 37, further comprising the step, prior to the routing step, of moving the frame defining a patient-support area away from the bed such that the patient is supported by the patient support material and not by the bed.

40. A system to assist in patient care comprising:

a patient support material positioned with respect to a patient bed such that the patient support material substantially lies on a plane substantially parallel to a plane of an upper patient receiving surface of the bed, the patient support material having at least one opening extending laterally across the patient support material such that it is adapted to extend under a patient resting on the patient support material;

a means for separating the patient support material from the upper patient receiving surface of the bed; and a patient transfer device including an elongated patient transfer components that is adapted to be inserted into the opening extending beneath a patient lying on the patient support material such that the elongated patient transfer component can be lifted above through the opening and thus transfer the patient from the patient support material to the elongated patient transfer component of the patient transfer device;

wherein the opening in the patient support material includes a resilient material extending thereacross that is more resilient than the patient support material.

41. The system of claim 40, wherein the separating means includes a means for vertically separating the patient support material from the upper patient receiving surface of the bed.

42. The system of claim 40, wherein the separating means includes a means for laterally separating the patient support material from the upper patient receiving surface of the bed.

43. The system of claim 40, wherein separating means includes a means for vertically and laterally separating the patient support material from the upper patient receiving surface of the bed.

44. The system of claim 40, wherein the patient transfer device is a powered patient lift mechanism.

45. The system of claim 40, wherein the patient transfer device is a transfer frame adapted to be secured about the patient.

46. The system of claim 45, further comprising a patient transfer mechanism adapted to be releasably coupled to the transport frame and to transfer the patient seated in the transfer frame.

* * * * *